US006115568A

United States Patent [19]

Sameshima

[11] Patent Number: 6,115,568

[45] Date of Patent: Sep. 5, 2000

[54] IMAGE FORMING APPARATUS WITH INTERMEDIATE TRANSFER MEMBER

[75] Inventor: Takao Sameshima, Mishima, Japan

[73] Assignee: Canon Kabushiki Kaisha, Tokyo, Japan

[21] Appl. No.: 09/031,794

[22] Filed: Feb. 27, 1998

[30] Foreign Application Priority Data

Feb. 27, 1997 [JP] Japan ..... 9-044310
Feb. 23, 1998 [JP] Japan ..... 10-040237

[51] Int. Cl.[7] ..... G03G 21/16

[52] U.S. Cl. ..... 399/110; 399/116; 399/121

[58] Field of Search ..... 399/110, 111, 399/121, 113, 302, 308, 167, 90, 116

[56] References Cited

U.S. PATENT DOCUMENTS

| | | | |
|---|---|---|---|
| 4,327,992 | 5/1982 | Babicz | 399/167 |
| 4,432,632 | 2/1984 | Yokota | 399/113 |
| 4,692,018 | 9/1987 | Tamura | 399/113 |
| 5,311,253 | 5/1994 | Ohmori et al. | 399/13 |
| 5,587,769 | 12/1996 | Sawada et al. | 399/113 |
| 5,651,540 | 7/1997 | Watanabe et al. . | |
| 5,666,595 | 9/1997 | Sameshima et al. . | |
| 5,745,823 | 4/1998 | Goto et al. | 399/111 |
| 5,787,326 | 7/1998 | Ogawa et al. | 399/121 X |
| 5,797,069 | 8/1998 | Kimura et al. | 399/113 |
| 5,809,376 | 9/1998 | Chiesa et al. | 399/111 |
| 5,887,228 | 3/1999 | Motohashi et al. | 399/111 |

FOREIGN PATENT DOCUMENTS

| | | |
|---|---|---|
| 63-149669 | 6/1988 | Japan . |
| 8-216468 | 8/1996 | Japan . |
| 8-272229 | 10/1996 | Japan . |
| 9-6087 | 1/1997 | Japan . |

*Primary Examiner*—Susan S. Y. Lee
*Attorney, Agent, or Firm*—Fitzpatrick, Cella, Harper & Scinto

[57] ABSTRACT

An image forming apparatus has an image bearing member unit with a rotatable image bearing member for holding an image, and an intermediate transfer member unit with a rotatable intermediate transfer member unit to which image on the image bearing member is transferred, the image transferred to the intermediate transfer member unit being transferred to a transfer material so that, the image bearing member unit and intermediate transfer member unit are detachable from a main body of the image forming apparatus in a direction perpendicular to a rotational axis of the image bearing member and the intermediate transfer member unit.

29 Claims, 26 Drawing Sheets

IMAGE FORMING APPARATUS WITH INTERMEDIATE TRANSFER MEMBER

BACKGROUND OF THE INVENTION

1. Field of the Invention

The present invention relates to an image forming apparatus for utilizing an electrophotographic process, and in particular to an image forming apparatus, such as a copying machine or a printer, that transfers a toner image borne on an image bearing member to an intermediate transfer member unit, and then transfers the toner image from the transfer member to a transfer material.

2. Related Background Art

An image forming apparatus is well known that performs the first transfer, to an intermediate transfer member unit, of a toner image that is formed on an electrophotographic photosensitive drum (hereinafter referred to as merely "photosensitive drum"), which serves as an image bearing member, and the second transfer of the toner image borne on the intermediate transfer member unit to a transfer material. Such an apparatus is effective as a color image forming apparatus or as multi-color image forming apparatus that sequentially transfers and laminates images including a plurality of color components, such as color image data and multi-color image data, and outputs the resultant color or multi-color image. It also is effective as an image forming apparatus that includes a color image forming function and a multi-color image forming function. With these apparatuses, an image that has no aberration in lamination of images for individual color elements (color aberration) can be acquired.

A well known intermediate transfer member unit and a photosensitive drum, which are durable parts, are designed to be detachable from the main body of the apparatus in a direction parallel to their rotary shafts in order to facilitate the exchange.

An intermediate transfer member unit that is detachable from the main body of an apparatus in a direction perpendicular to its rotary shaft has been proposed in Japanese Patent Laid-Open Application No. 9-6087. If the intermediate transfer member unit can be detached from the main body of the apparatus in the direction parallel to the rotary shaft, an opening that is large enough to permit the intermediate transfer member unit to pass through must be formed in the frame of the apparatus that supports the rotary shaft of the transfer member. As a result, the strength of the apparatus is reduced and the rotation of the intermediate transfer member unit will be uneven due to the reduction in the strength of the apparatus. The intermediate transfer member unit proposed in the above conventional art eliminates this problem. In the above above conventional art, other durable parts, such as a photosensitive drum, are not desired as being detachable from the main body of the apparatus for exchange.

As in the conventional, well known image forming apparatus, when the intermediate transfer member unit and the photosensitive drum are detachable from the apparatus, an opening large enough for both the intermediate transfer member unit and the photosensitive drum to pass through is required in an apparatus frame that supports the rotary shafts of the intermediate transfer member unit and the photosensitive drum. As a result, the strength of the apparatus is reduced and the rotation of the intermediate transfer member unit and the photosensitive drum will be uneven due to the reduction of the strength.

In addition, when, for example, a plurality of durable parts, such as an intermediate transfer member unit and a photosensitive drum, are detachable from the apparatus in a variety of directions, i.e., either from the front, from the rear, from the top, from the left or from the right, a user will become confused as to what durable part is to be exchanged in which direction.

SUMMARY OF THE INVENTION

It is one object of the present invention to provide an image forming apparatus that can prevent a reduction in the strength of the apparatus.

It is another object of the present invention to provide an image forming apparatus with which the performance of maintenance by a user during the exchange of devices is enhanced.

It is an additional object of the present invention to provide an image forming apparatus wherein a problem caused by a jam can be easily eliminated.

DETAILED DESCRIPTION OF THE PREFERRED EMBODIMENT

The preferred embodiment of the present invention will now be described while referring to the accompanying drawings.

Figure 1:
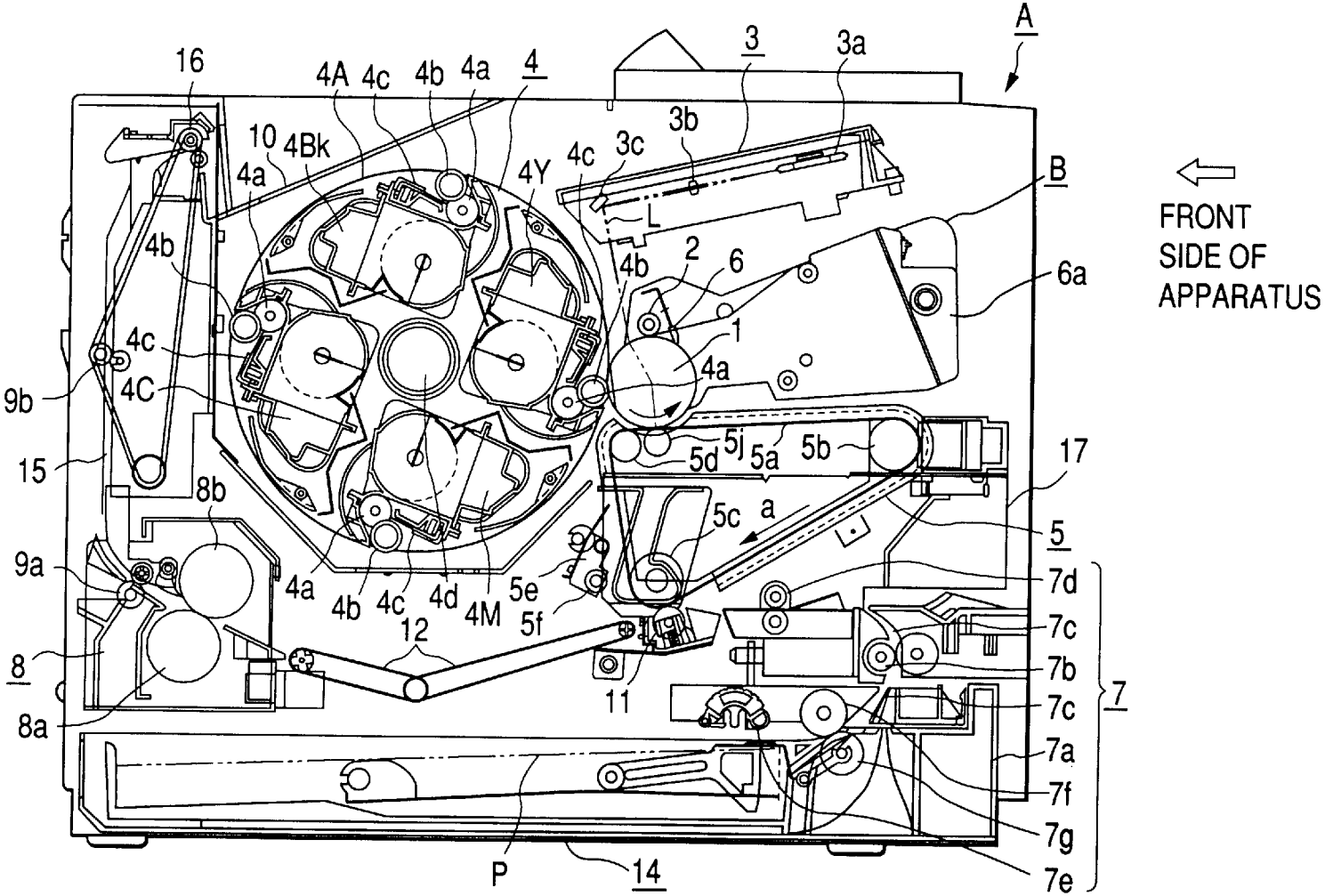
FIG. 1 is a vertical cross-sectional view of an image forming apparatus according to one embodiment of the present invention.

FIG. 1 is a vertical cross-sectional view of the general schematic arrangement of an electrophotographic image forming apparatus (hereinafter referred to as an image forming apparatus) according to the present invention.

The schematic arrangement of an image forming apparatus A (a four, full-color laser beam printer) will now be described while referring to FIG. 1.

The image forming apparatus A includes a photosensitive drum 1 that serves as an image bearing member. The photosensitive drum 1 is rotated counterclockwise by drive means (not shown). Sequentially provided around the photosensitive drum 1 in the direction of rotation are a charging unit 2, which serves as charging means for uniformly charging the surface of the photosensitive drum 1; an exposing unit 3, which irradiates the photosensitive drum 1 with a laser beam L based on image data and forms an electrostatic latent image on the surface of the photosensitive drum 1; a developing unit 4, which attaches toner to an electrostatic latent image and develops it into a toner image; an intermediate transfer belt 5*a*, which serves as an intermediate transfer member unit to which the toner image on the photosensitive drum 1 is first transferred; and cleaning device 6, which serves as cleaning means for removing residual toner from the surface of the photosensitive drum 1 after the first transfer is completed.

The photosensitive drum 1, the charging unit 2 and the cleaning device 6 that removes toner are integrally formed and constitute a process cartridge B, which is an image holding unit that is detachable from the main body of the image forming apparatus A. Although in this embodiment the cartridge B includes the charging unit 2 and the cleaning device 6, it is not limited to them, and only one or the other need be included.

In the main body 14 are provided a feeding unit 7, for feeding a transfer medium P, such as paper, to an intermediate transfer member unit 5; a secondary transfer roller 11, for transferring to the transfer member P a toner image that is first transferred to the intermediate transfer belt 5*a*; and paired discharge rollers 9*a* and 9*b*, for discharging to a discharge tray 10 the transfer medium P to which the toner image has been transferred.

The photosensitive drum 1 is formed by applying an organic optical conductive layer (OPC photosensitive material) to the external surface of, for example, an aluminum cylinder having a diameter of about 47 mm. The photosensitive drum 1 is rotatably supported at its ends by a support member, and, upon receipt at one end of a driving force produced by drive means (not shown), is rotated in the direction indicated by the arrow.

A so-called contact charging unit, which is disclosed, for example, in Japanese Patent Laid-Open Application No. 63-149669, can be used as the charging unit 2. When a charging member, which is a conductive roller, is brought into contact with the surface of the photosensitive drum 1, and when a bias charge vias voltage is applied to the roller by a power source (not shown), the surface of the photosensitive drum 1 is uniformly charged.

In the exposing unit 3 is a polygon mirror 3*a*, which is irradiated by a laser diode (not shown) with an imaging light beam corresponding to an image signal. The polygon mirror 3*a* is rotated rapidly by a scanner motor (not shown), and the reflected imaging light beam, which passes through a focusing lens 3*b* and is reflected by a reflection mirror 3*c*, selectively exposes and forms an electrostatic latent image thereon.

The developing unit 4 includes a rotary member 4A that can be rotated around a shaft 4*d* by indexing; and four developers mounted thereon, i.e., developers 4Y, 4M, 4C and 4Bk, that contain yellow, magenta, cyan and black toners.

To develop the electrostatic latent image on the photosensitive drum 1, a developer for a color to be attached to the electrostatic latent image is positioned at a development location. That is, as the rotary member 4A is rotated by indexing, a specific developer is moved to and halted at a development location opposite the photosensitive drum 1. At this time, the development sleeve of the developer is so positioned that the sleeve and the developer face the photosensitive drum 1 and are separated from it by a minute interval (about 300 $\mu$m). Subsequently, the electrostatic latent image on the photosensitive drum 1 is developed.

This development process is performed as follows. Toner corresponding to a color to be developed is conveyed from the developer container and supplied to a coating roller 4*a* by a feeding mechanism. A thin layer of toner is then applied to the external surface of a rotating development sleeve 4*b* by the rotating coating roller 4*a* and a toner regulation blade 4*c*. At this time, an electric charge is acquired by the toner (friction charge or electrification). Thus, when a development bias is applied between the development sleeve 4*b* and the photosensitive drum 1 on which an electrostatic latent image is formed, the toner is attached to the electrostatic latent image and develops the latent image into a toner image.

When the developers are positioned at the development location, the development sleeves 4*b* of the individual developers 4Y, 4M, 4C and 4Bk are connected to respective high voltage color development power sources (not shown) that are provided for the main body 14, and a voltage is selectively applied for the development of each color. The developers 4Y, 4M, 4C and 4Bk are individually detachable from the rotary member 4A, which in turn is detachable from the main body 14.

The intermediate transfer unit 5, which has an intermediate transfer belt 5*a* that runs in the direction indicated by the arrow a, performs a secondary transfer process where a plurality of toner images that are laminated in order during the first transfer from the photosensitive drum 1.

The intermediate transfer belt 5*a* in this embodiment has a length of 440 mm, and is fitted around a drive roller 5*b*, a secondary transfer roller 5*c* and a follow-up roller 5*d*. In addition, a first transfer roller (pressing roller) 5*j* is also located near the follow-up roller 5*d* and alternates between a location where the intermediate transfer belt 5*a* is pressed against the photosensitive drum 1 and a location where the intermediate transfer belt 5*a* is separated from the photosensitive drum 1.

The intermediate transfer belt 5*a* runs in the direction indicated by the arrow a in consonance with the rotation of the drive roller 5*b*. The rotary shaft of the intermediate transfer belt 5*a* (the rotary shaft of the drive roller 5*b*) is substantially parallel to the rotary shaft of the photosensitive drum 1. A cleaning unit 5*e*, which can contact or be separated from the surface of the intermediate transfer belt 5*a*, is located at a predetermined location adjacent to the outer surface of the intermediate transfer belt 5*a* for removing residual toner from the transfer medium P after the secondary transfer has been completed. The cleaning unit 5*e* brings a charging roller 5*f* into contact with the intermediate transfer belt 5*a*, and applies, to the toner, an electric charge having a polarity opposite to that employed during the transfer process. Following this, the toner to which the electric charge having the opposite polarity is applied is electrostatically attached to the photosensitive drum 1, and is thereafter collected by the cleaning device 6 for the photosensitive drum 1. The cleaning method used for the intermediate transfer belt 5*a* is not limited to the above described electrostatic cleaning; a mechanical method using a blade or a fur brush, or a combination method may also be employed.

The cleaning device 6 removes so-called transfer toner residue, i.e., toner that was attached to the photosensitive drum 1 by the developer 4 but was not transferred to the intermediate transfer belt 5*a* and remained on the surface of the photosensitive drum 1. The residual toner is accumulated in a cleaning container 6*a* of the cleaning device 6.

The feeding unit 7 feeds the transfer medium P to a transfer nip portion between the intermediate transfer belt 5*a* and the secondary transfer roller 11, and includes a paper cassette 7*a*, in which a plurality of transfer media P are stored, that is loaded into the lower portion of the main body 14. For the image forming operation, a pickup member 7*e*, a feed roller 7*f*, a retard roller 7*g* and a delivery roller pair 7*b* are rotated and separately feed the individual transfer media P in the paper cassette 7*a*. Within the feeding unit 7, the transfer medium P is guided along a guide plate 7*c* and passed through a resist roller pair 7*d*, and is re-supplied to the intermediate transfer belt 5*a* in synchronization with image start positioning.

The fixing unit 8 fixes a plurality of toner images that are secondarily transferred to a transfer medium P, and includes a rotary heat roller 8*b* and a pressure roller 8*a*, which presses against the roller 8*b*, that together apply heat under pressure to the transfer medium P. That is, the transfer medium P passes over the secondary transfer roller 11, whereat simultaneous transfer of the toner on the intermediate transfer belt 5*a* is effected, then is carried along the delivery belt 12, and is thereafter propelled forward by the pressure roller 8*a* and the heat roller 8*b* when passing through the fixing unit 8. At this time, heat is applied under pressure by the heat roller 8*b* and the pressure roller 8*a*. As a result, a plurality of color toner images are fixed to the surface of the transfer medium P.

The intermediate transfer unit 5, the cleaning unit 5*e*, and the delivery roller pair 7*b* and the resist roller pair 7*d*, which are transportation means, are attached to a drawing unit 17 that serves as first drawing unit means. These components can be horizontally drawn out from the front, together with the drawing unit 17, relative to the front (the right side in FIG. 1) of the main body 14.

The image forming processing performed by the thus arranged image forming apparatus will now be described.

First, the photosensitive drum 1 is rotated counterclockwise in the direction indicated by an arrow, in synchronization with the movement of the intermediate transfer belt 5*a*. The surface of the photosensitive drum 1 is uniformly electrified by the charging unit 2, and then is irradiated with yellow imaging light by the exposing unit 3, so that a yellow electrostatic latent image is formed on the photosensitive drum 1. At the same time as the electrostatic latent image formation, the developing unit 4 is driven and the yellow developer 4Y is positioned at the development location. A voltage is applied that has the same polarity and substantially the same potential as the charge on the photosensitive drum 1, and yellow toner is attached to the electrostatic latent image on the photosensitive drum 1 and develops the image. Following this, a voltage having a polarity opposite to that of the toner is applied to the first transfer roller (pressure roller) 5*j*, and the yellow toner image on the photosensitive drum 1 is transferred to the intermediate transfer belt 5*a*.

When the first transfer of the yellow toner image has been completed, the next developer is rotated and positioned at the development position opposite the photosensitive drum 1. For the magenta, cyan and black colors, the formation of an electrostatic latent image, the development and the first transfer are sequentially preformed in the same manner as that for the yellow toner image, and the four color toner images are superimposed on the intermediate transfer belt 5*a*. During this process, the second transfer roller 11 and the charge roller 5*f* of the cleaning unit 5*e* are separated from the intermediate transfer belt 5*a*. When the four-color toner image has been formed on the intermediate transfer belt 5*a*, the second transfer roller 11 is pressed against the intermediate transfer belt 5*a*, and the feeding of the transfer medium P that is held by the resist roller pair 7*d* is synchronized with the movement of the intermediate transfer belt 5*a*.

The transfer medium P, to which all of the toner image is secondarily transferred, is transported simultaneously to the fixing unit 8 by the delivery belt 12. There, the toner image is fixed to the transfer medium P, which is then propelled along a discharge paper guide 15 by the paired discharge rollers 9*a* and 9*b* and is discharged to the discharge tray 10. The image forming processing is thereafter terminated.

Figure 2:
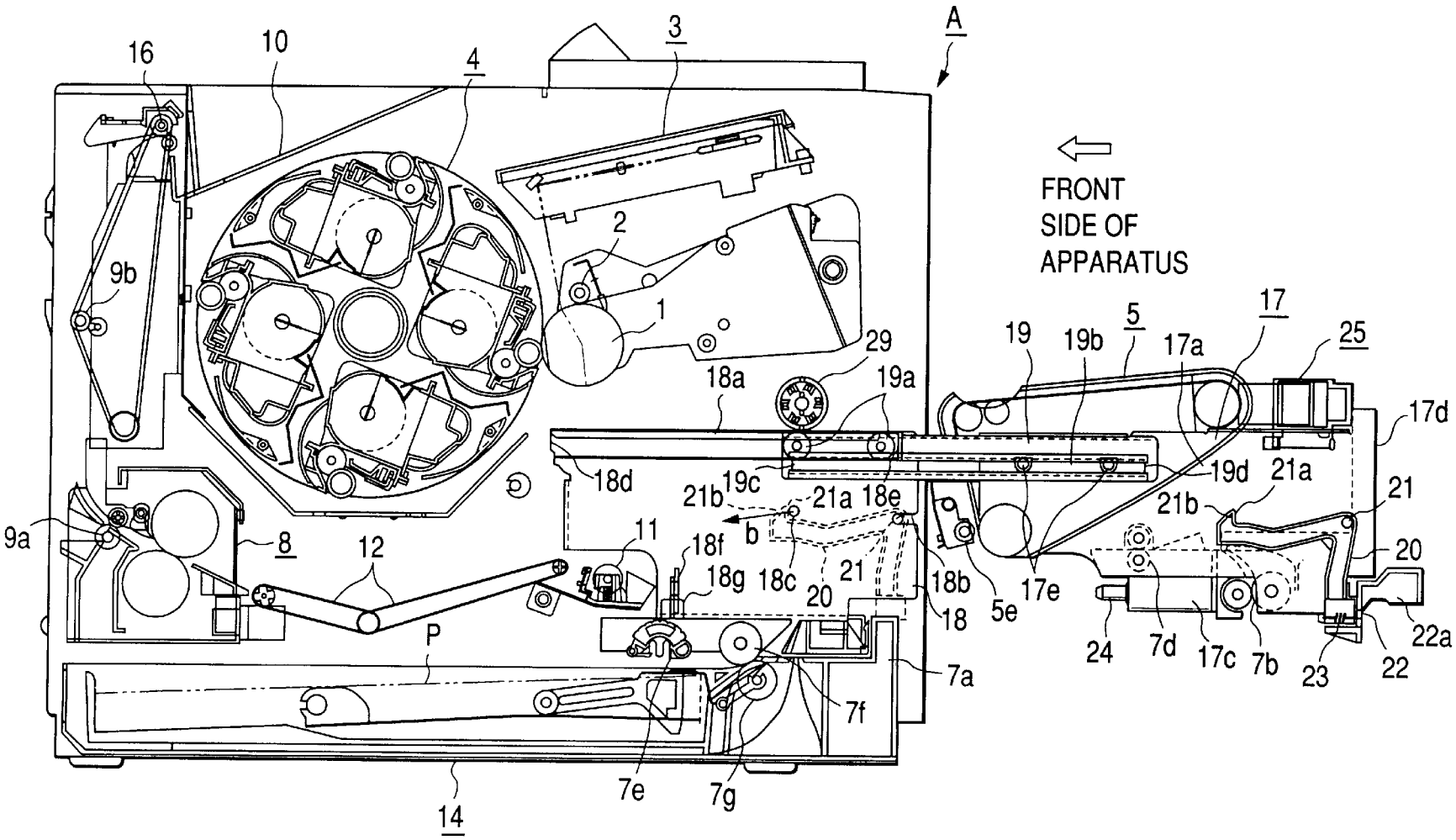
FIG. 2 is a vertical cross-sectional view of the image forming apparatus when an intermediate transfer member unit is pulled out of the apparatus.

The operation for drawing the intermediate transfer unit 5 out of the main body 14 will now be described while referring to FIG. 2. FIG. 2 is a schematic cross-sectional view of the state when the intermediate transfer unit 5 is drawn out of the main body 14.

The drawing unit 17, on which the intermediate transfer unit 5 is positioned and mounted and which is pulled out from the front of the main body 14, comprises a left drawing unit side plate 17*a*, a right drawing unit side plate 17*b* (see FIG. 5), a lower drawing unit frame 17*c* and a front drawing unit frame 17*d*.

Guide pins 17*e* are provided at two places on the left drawing unit side plate 17*a*, and are movably inserted into a groove 19*b* in a second rail 19. Rollers 19*a* are located at two places at the end of the second rail 19. The rollers 19*a* are fitted into the guide portion of a first rail 18*a*, provided for a rail stay 18 on the side of the main body 14. The right drawing unit side plate 17*b* has the same arrangement as has the left drawing unit side plate 17*a*. Two rollers 19*a* are fitted into the guide portion of the first rail 18*a*, provided for the rail stay 18 of the main body 14.

With this arrangement, the drawing unit 17 moves from a stopper 18*d* at the end of the first rail 18*a* to a stopper 18*e* at the other end, and from a stopper 19*c* at one end of the second rail 19 to a stopper 19*d* at the other end, while the entire intermediate transfer unit 5 is horizontally pulled out from the front of the main body 14. In this embodiment, the drawing unit 17 is pulled out about 300 mm from the storage state shown in FIG. 1.

In addition to the basic components, locking levers 20 are provided outside the right side plates 17*a* and 17*b* of the drawing unit 17, and are linked together by a coupling plate 22 having a handle 22*a*. The locking levers 20 are rotatably attached at their centers by positioning pins 21 having identical shafts, and are driven by a tension spring 23. Positioning pins 24 are provided on either side of the lower drawing unit frame 17*c*, and also attached to the drawing unit 17 and the cleaning unit 5*e*, the delivery roller pair 7*b* and the resist roller pair 7*d*, which can be pulled out together with the drawing unit 17. In FIG. 2, an intermediate transfer unit pressing/sliding unit 25 and an intermediate transfer unit positioning member 29 are also provided, and will be described in detail later.

When the drawing unit 17 that extends from the front of the main body 14 is to be returned to the interior of the main body 14, it is pushed into the main body 14 until a positioning pin 25 engages a positioning hole 18*f* in the rail stay 18, while the positioning pins 21 engage a positioning groove 18*b* formed in the rail stay 18.

First tapered faces 21*b* of the locking levers 20 slide under locking pins 18*c* on the rail stay 18 until the locking pins 18*c* are engaged by second tapered faces 21*a* when the reaction force is generated by the tension spring 23 and pushes the drawing unit 17 away from the first tapered faces 21*a* of the locking levers 20 in the direction indicated by an arrow b. Thus, the drawing unit 17 is pressed against a positioning stopper 18*g* on the rail stay 18 and is positioned there. To pull the drawing unit 17 out to the front, the handle 22*a* is pulled out toward the front of the main body 14, the second tapered faces 21*a* of the locking levers 20 disengage the locking pins 18*c*, and the drawing unit 17 is withdrawn as is shown in FIG. 2.

The processing for the detachment of the intermediate transfer unit 5 from the drawing unit 17 will now be described.

Figure 3:
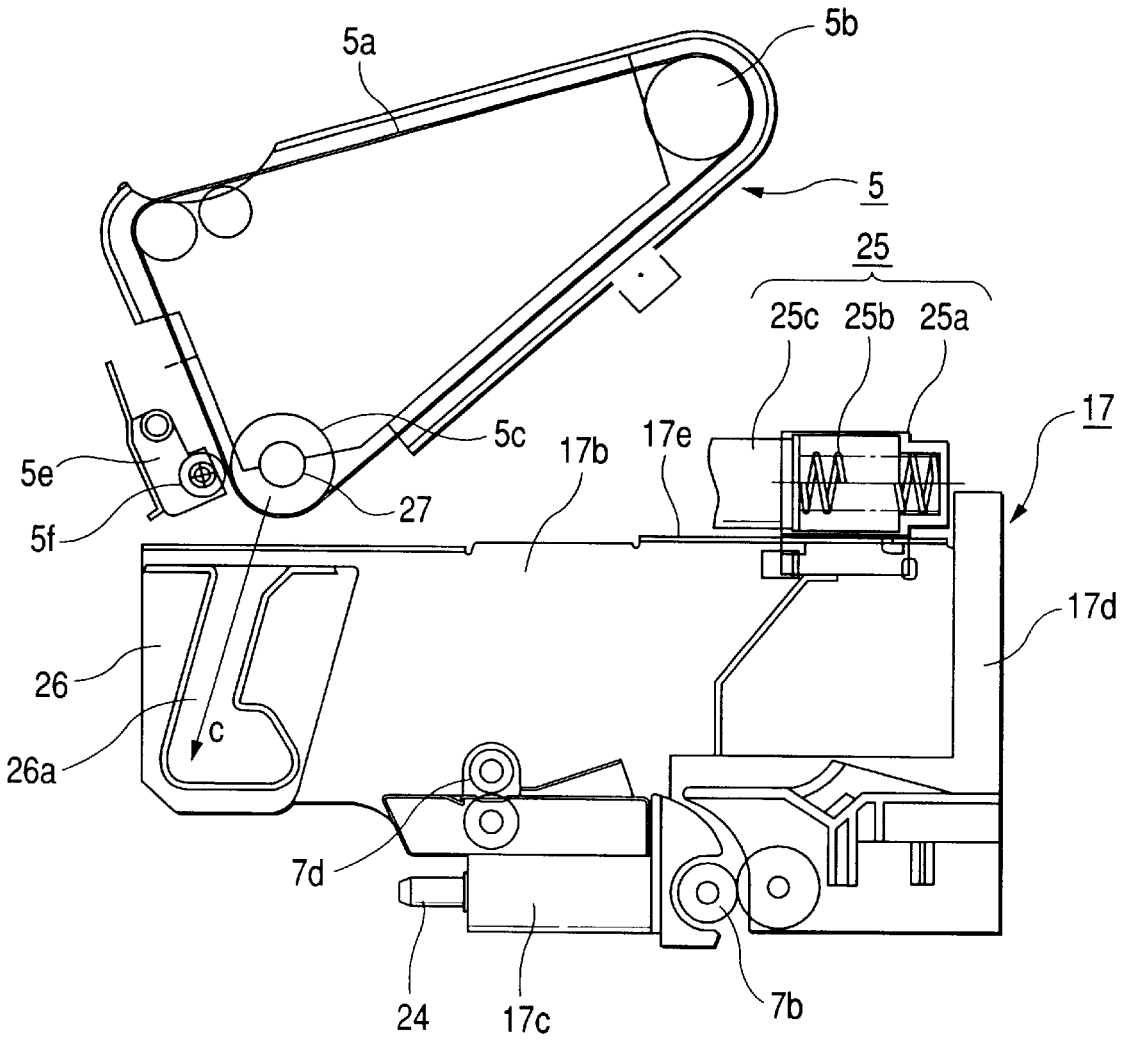
FIG. 3 is a vertical cross-sectional view of the state where the intermediate transfer member unit is to be mounted on a drawing unit.

As is shown in FIG. 3, a guide plate 26 and an intermediate transfer unit pressing/sliding unit 25 are provided for each of the left and right drawing unit side plates 17*a* and 17*b* of the drawing unit 17. When the intermediate transfer unit 5 is to be attached to the drawing unit 17 that has been pulled out of the main body 14, guide shafts 27, which on both sides are coaxially provided with the second transfer opposing roller 5*c* of the intermediate transfer unit 5, are inserted into guide grooves 26*a* in the guide plates 26 in the direction indicated by arrow c.

Figure 4:
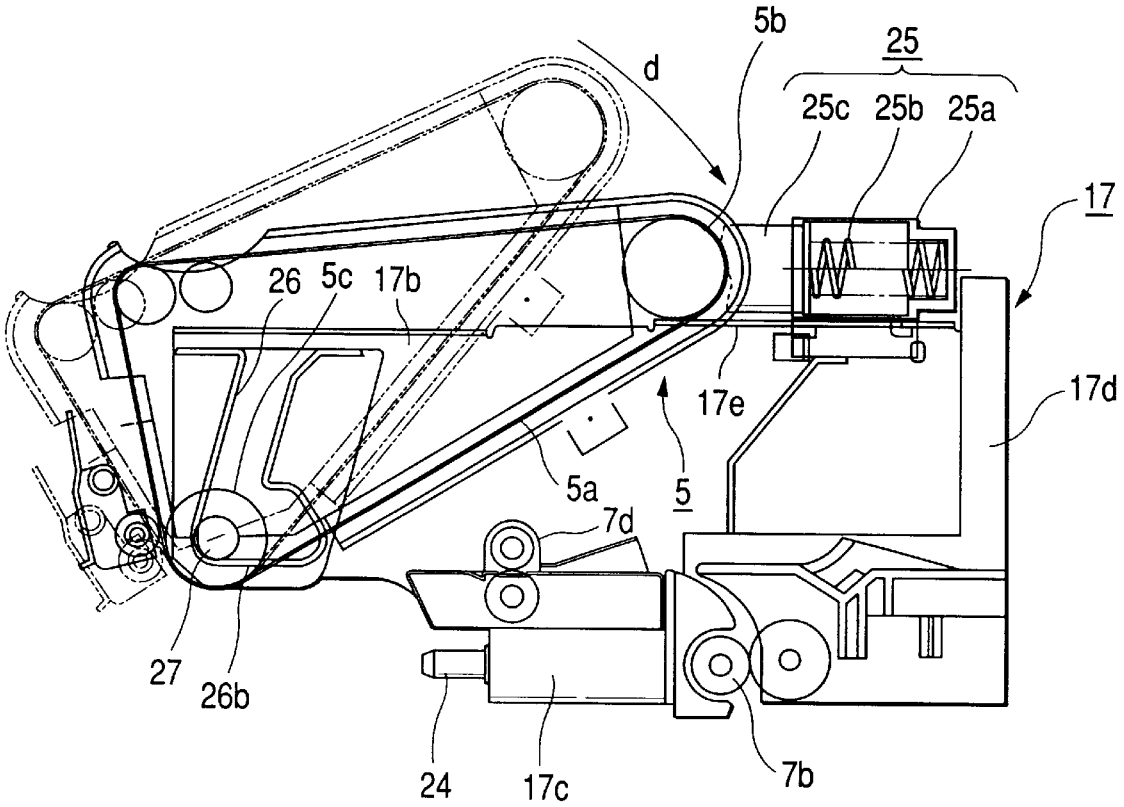
FIG. 4 is a vertical cross-sectional view of the state where the intermediate transfer member unit is mounted on a drawing unit.

Then, when as is shown in FIG. 4 the guide shafts 27 rest on bottoms 26*b* of the guide grooves 26*a*, the intermediate transfer unit 5 is rotated at the guide shafts 27 in the direction indicated by an arrow d. Bearings 28 (see FIG. 5) at the ends of the drive roller 5*b* are mounted on table portions 17*e* provided for the individual left and right drawing unit side plates 17*a* and 17*b* of the drawing unit 17. As a result, the intermediate transfer unit 5 is mounted on the drawing unit 17. The intermediate transfer pressing/sliding units 25 each comprise a pressing member 25*c*, a compression spring 25*b* and a pressing member guide 25*a*. In the state shown in FIG. 4, the pressing members 25*c* push the bearings 28 (see FIG. 5) slightly to the left at both ends of the drive roller 5*b* of the intermediate transfer unit 5. To remove the intermediate transfer unit 5 from the intermediate transfer pressing/sliding units 25, the processing need only be performed in reverse.

The positioning process for the intermediate transfer unit 5 relative to the main body 14 will now be explained.

Figure 5:
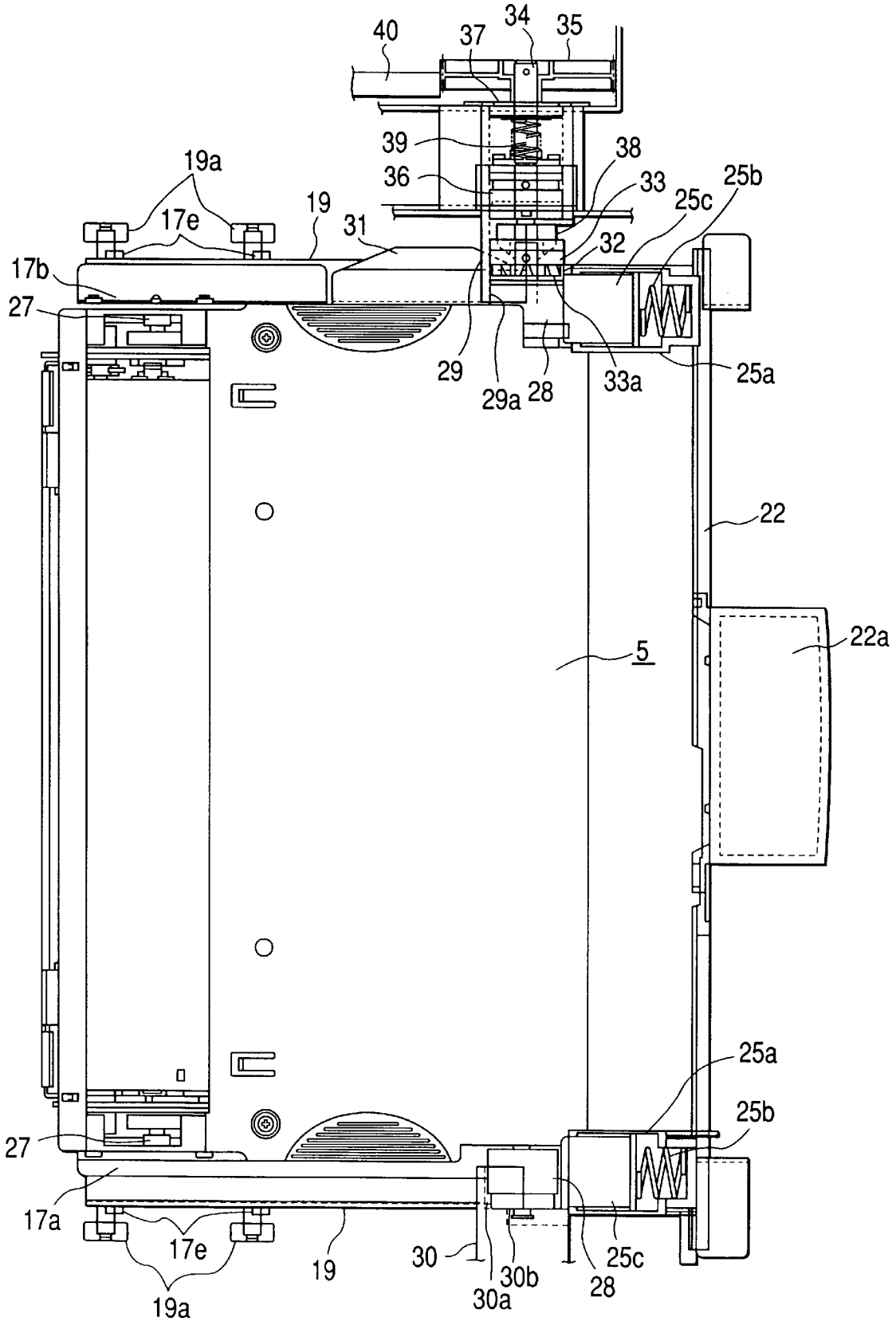
FIG. 5 is a top view of the state where the intermediate transfer member unit is mounted on the main body of the apparatus.

When the drawing unit 17, on which the intermediate transfer unit 5 in FIG. 2 is mounted, is pushed into the main body 14, as is described above the positioning units 21 and 24 of the drawing unit 17 respectively engage the positioning groove 18 and the positioning hole 18*f* formed in the rail stay 18 of the main body 14 to stabilize the direction in which the drawing unit 17 is pushed. Following this, as is shown in FIG. 5, the bearings 28 on both sides of the intermediate transfer unit 5 abut upon the intermediate transfer unit positioning members 29 and 30, which are coaxially formed on both sides of the main body 14. In FIG. 5, the distal end of the intermediate transfer unit positioning member 30 is not shown.

Figure 8:
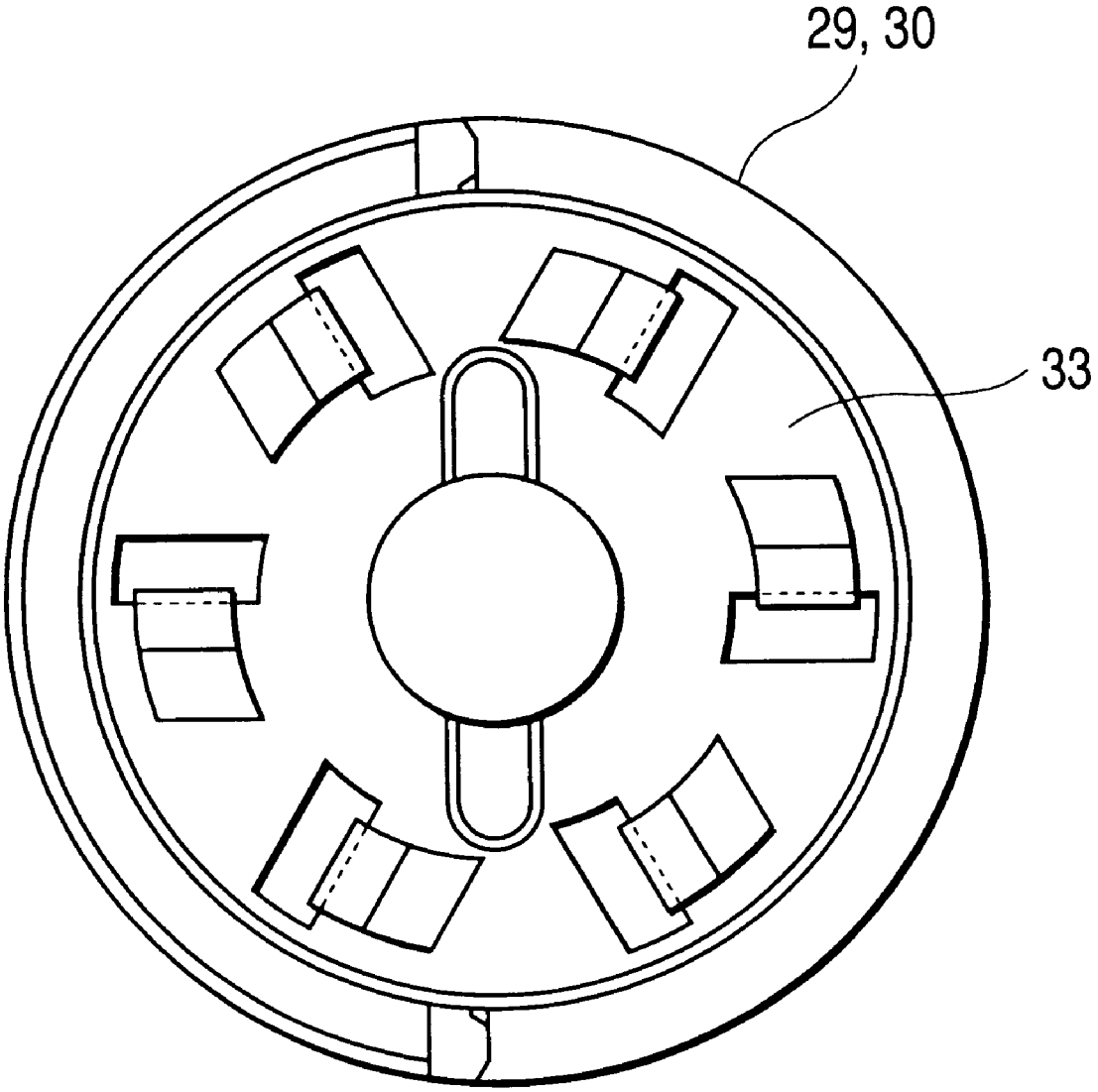
FIG. 8 is a side view of an intermediate transfer member unit positioning member.

The intermediate transfer unit positioning members 29 and 30 are a pipe shaped with half the surface at the front cut off (see FIG. 8). As is shown in FIG. 5, the bearings 28 on both sides of the intermediate transfer unit 5 contact internal curve faces 29*a* and 30*a* of the positioning members 29 and 30, and the intermediate transfer unit 5 is halted at this position. Since the intermediate transfer unit positioning members 29 and 30 are located at such a position that the bearings 28 of the intermediate transfer unit 5 are slightly lifted up from the tables on which they are mounted, the drive roller 5*b* of the intermediate transfer unit 5 is positioned by the intermediate positioning members 29 and 30 of the main body 14 so that it is lifted up from the drawing unit 17.

Figure 7:
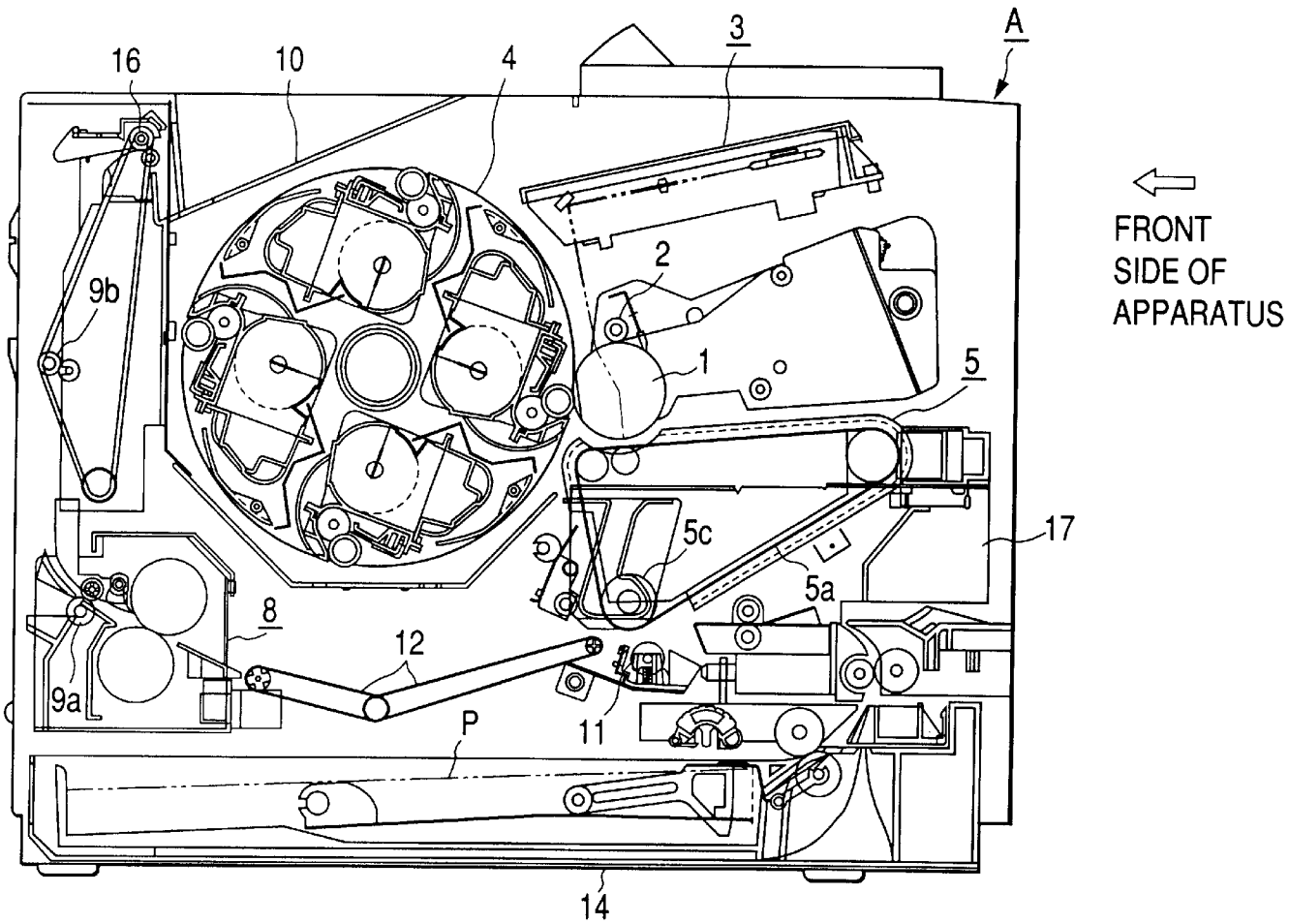
FIG. 7 is a vertical cross-sectional view of the image forming apparatus according to the embodiment of the present invention before it performs the image forming process.

The drawing unit 17 is pushed into the main body 14 until it is locked by the locking levers 20, and thus is set and is prepared for image forming, as is shown in FIG. 7. In this state, the bearings 28 on both sides of the drive roller 5*b* are pressed against the curved faces 29*a* and 30*a* by the pressing members 25*c* provided for the drawing unit 17.

The transmission of the rotational force to the intermediate transfer unit 17, and the release from the rotational force will now be described.

Figure 9:
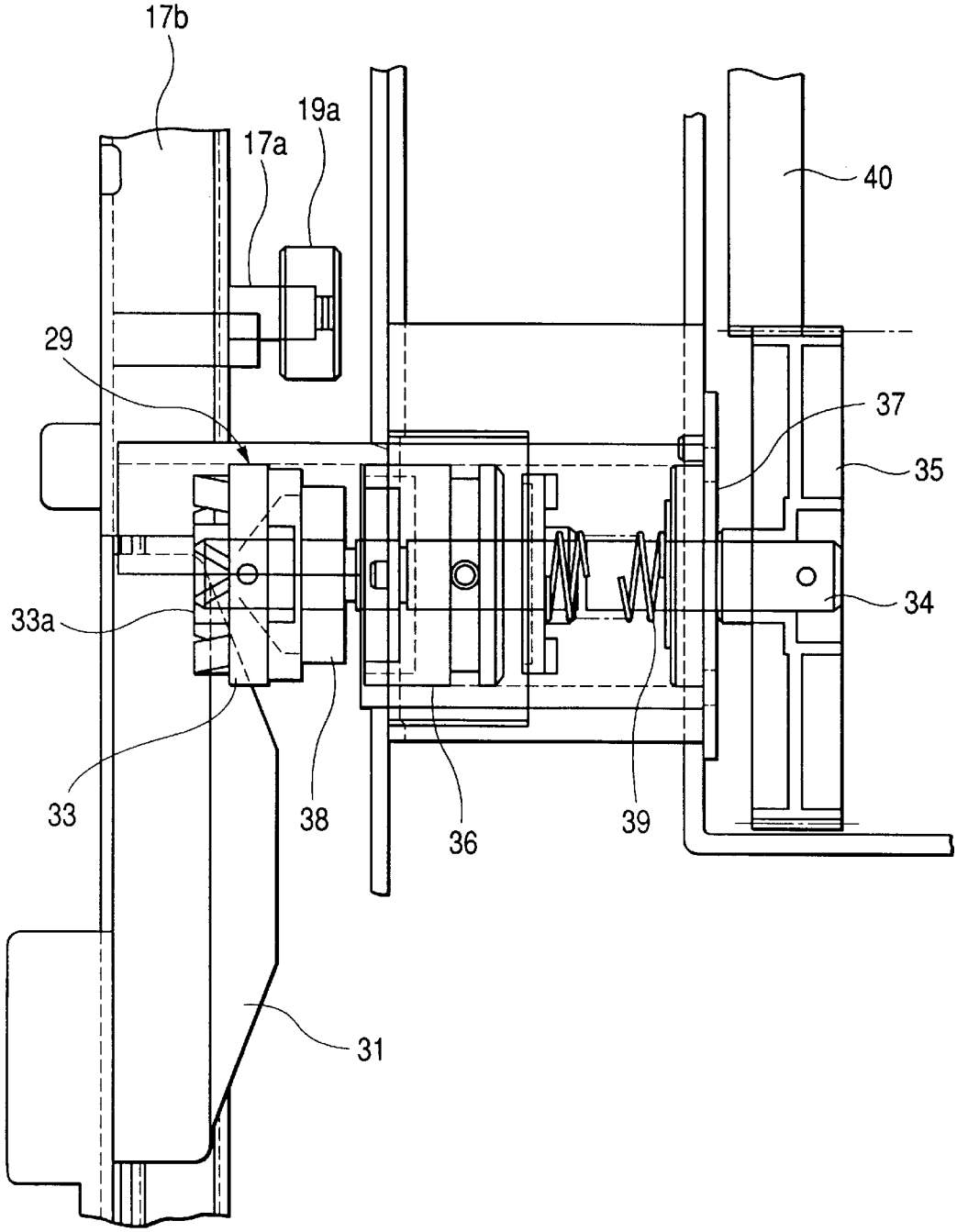
FIG. 9 is a top view of the state where driving force transmission means is coupled with the intermediate transfer member unit.
Figure 10:
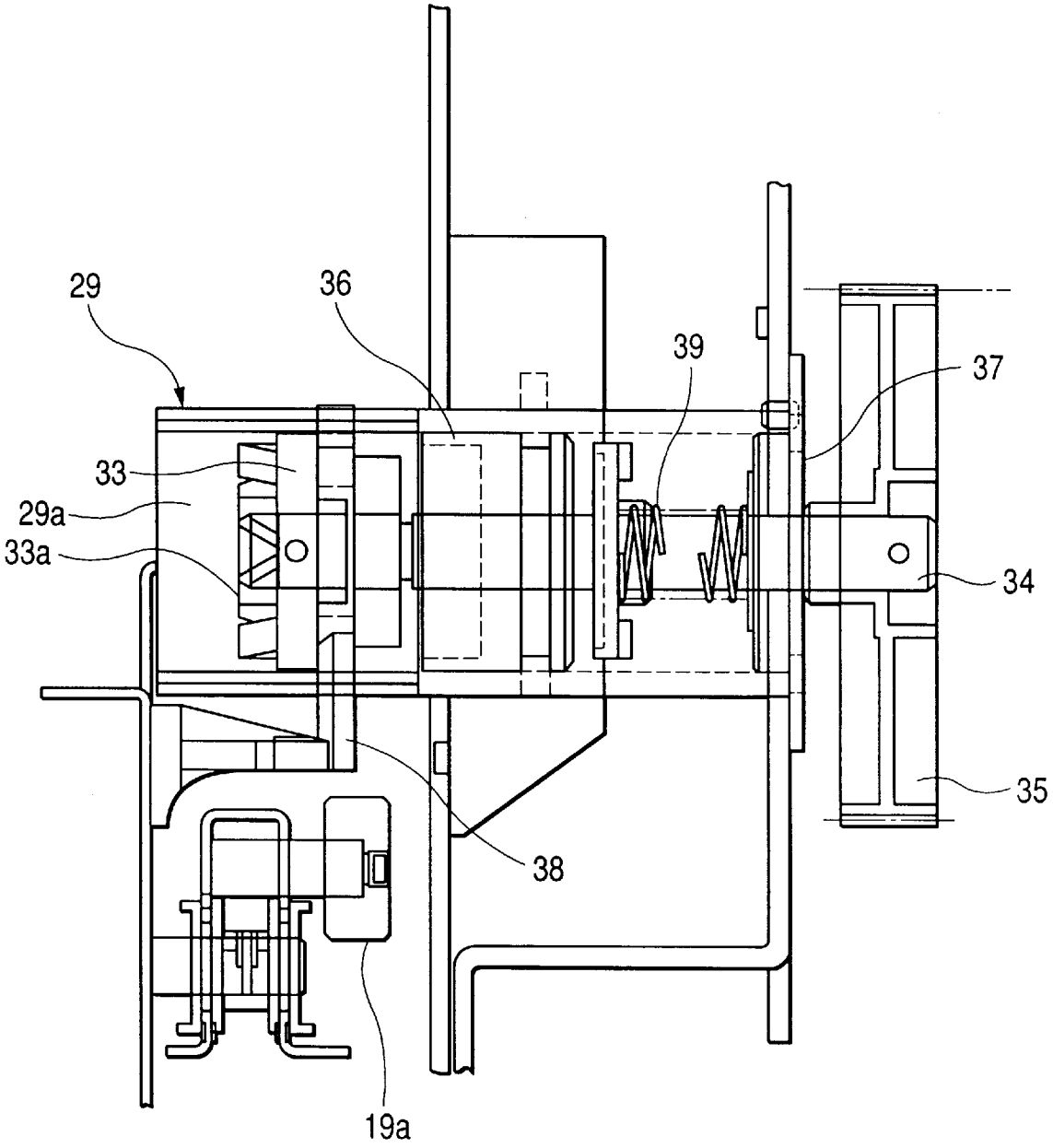
FIG. 10 is a front view of the state where the driving force transmission means is coupled with the intermediate transfer member unit.

FIG. 9 is a top view of the state where the rotational force is transmitted to the intermediate transfer unit 5, and FIG. 10 is a front view.

In each of the intermediate transfer unit positioning members 29 and 30, a drive coupling 33 is fixed to a drive shaft 34, and a first gear 35 is fixed to one end. The drive shaft 34 is movably supported by bearings 36 and 37 inside the intermediate transfer unit positioning member 29 or 30. Immediately after the drive coupling 33 is fixed to the drive shaft 34, a coupling release cam 38 is fixed to the drive shaft 34, and a return spring 39 is located between the bearings 36 and 37.

In FIG. 9 or 10 is shown the state before a follow-up coupling 32 of the intermediate transfer unit 5 in FIG. 5 is connected to the drive coupling 33. These components have the same positional relationship when they are engaged. A fixed cam 31 that is provided for the drawing unit 17 is raised immediately before the follow-up coupling 32, and the coupling release cam 38 and the drive coupling 33 are pushed down. As a result, when the intermediate transfer unit 5 is positioned to the main body 14, the drive coupling 33 is returned by the return spring 39. Thereafter, the coupling is completed.

The intermediate transfer unit 5 is driven against the end 30*b* of the positioning member 30 of the main body 14 by the return spring 39. Several pawls 33*a* having inclined faces are provided for the drive coupling 33. As the drive coupling 33 is rotated, the pawls 33*a* fall into several holes formed in the follow-up coupling 32 of the intermediate transfer unit 5. The engagement is thereafter completed. The rotational force is transmitted from a second gear 40, which is on the side of an engaged rotation member (not shown), to the first gear 35, and to the intermediate transfer unit 5.

Figure 11:
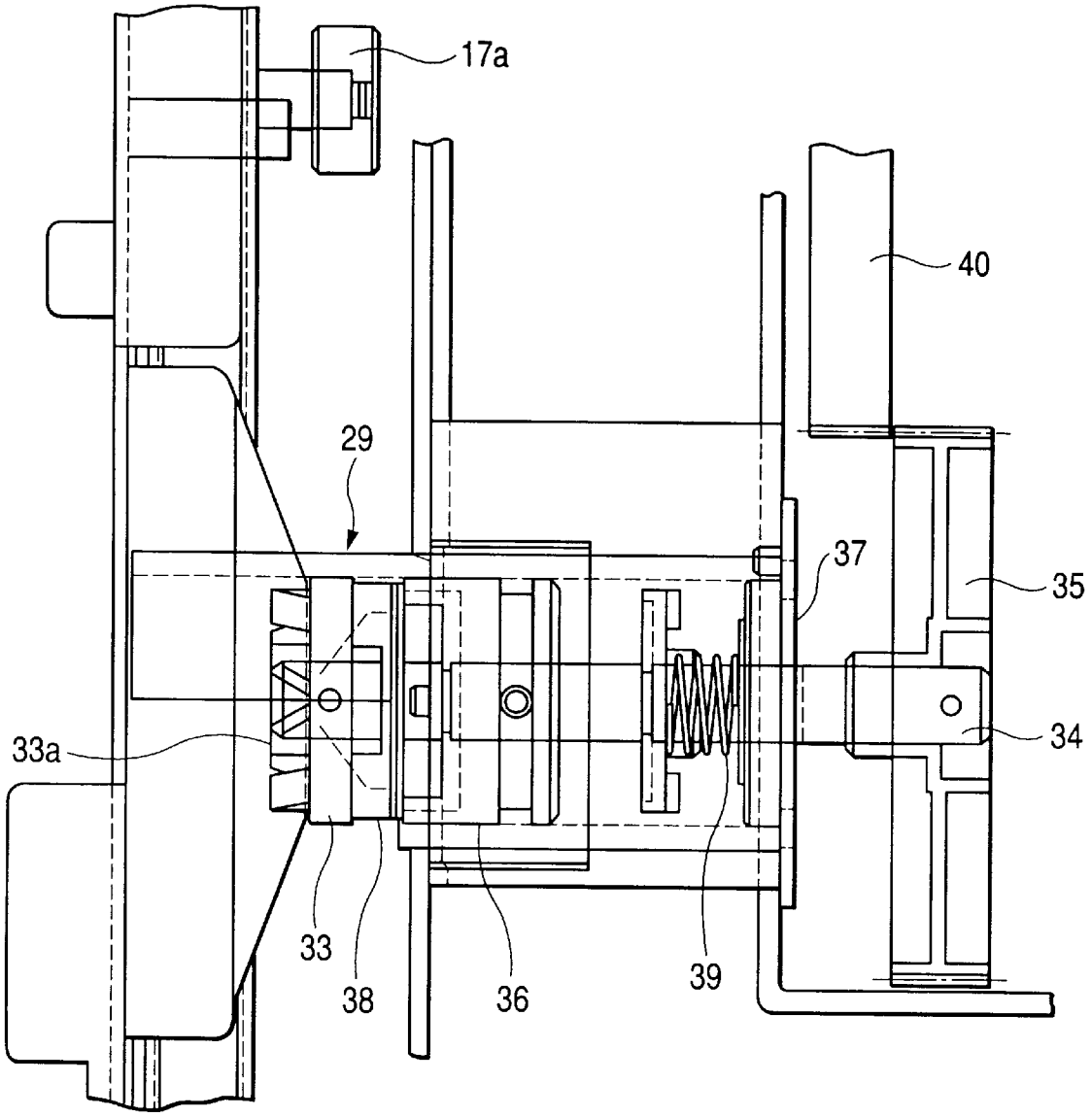
FIG. 11 is a top view of the state where the driving force transmission means is disconnected from the intermediate transfer member unit.
Figure 12:
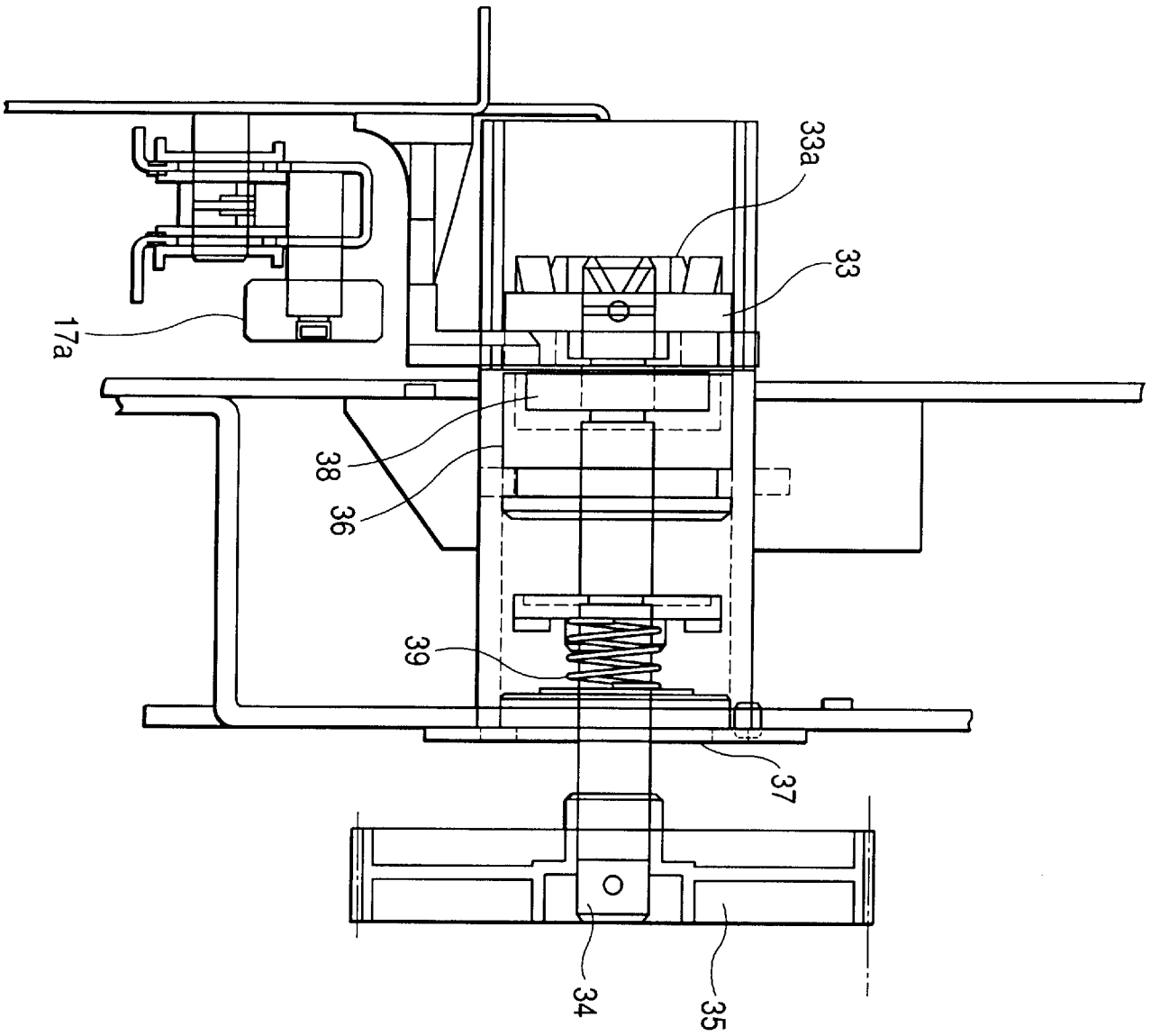
FIG. 12 is a front view of the state where the driving force transmission means is disconnected from the intermediate transfer member unit.

In FIGS. 11 and 12 is shown the state where the follow-up coupling 32 of the intermediate transfer unit 5 is released from the drive coupling 33 of the main body 14. The drive coupling 33 is moved to the right in the drawings so that it does not interfere with the follow-up coupling 32. With this disengagement, the first gear is also moved to the right in the drawings and disengages the second gear 40, so that the rotational force is not transmitted to the follow-up coupling 32.

An explanation will now be given for the operation for shifting from the state wherein the intermediate transfer unit 5 has been mounted in the main body 14 to the image forming enabled state.

Figure 6:
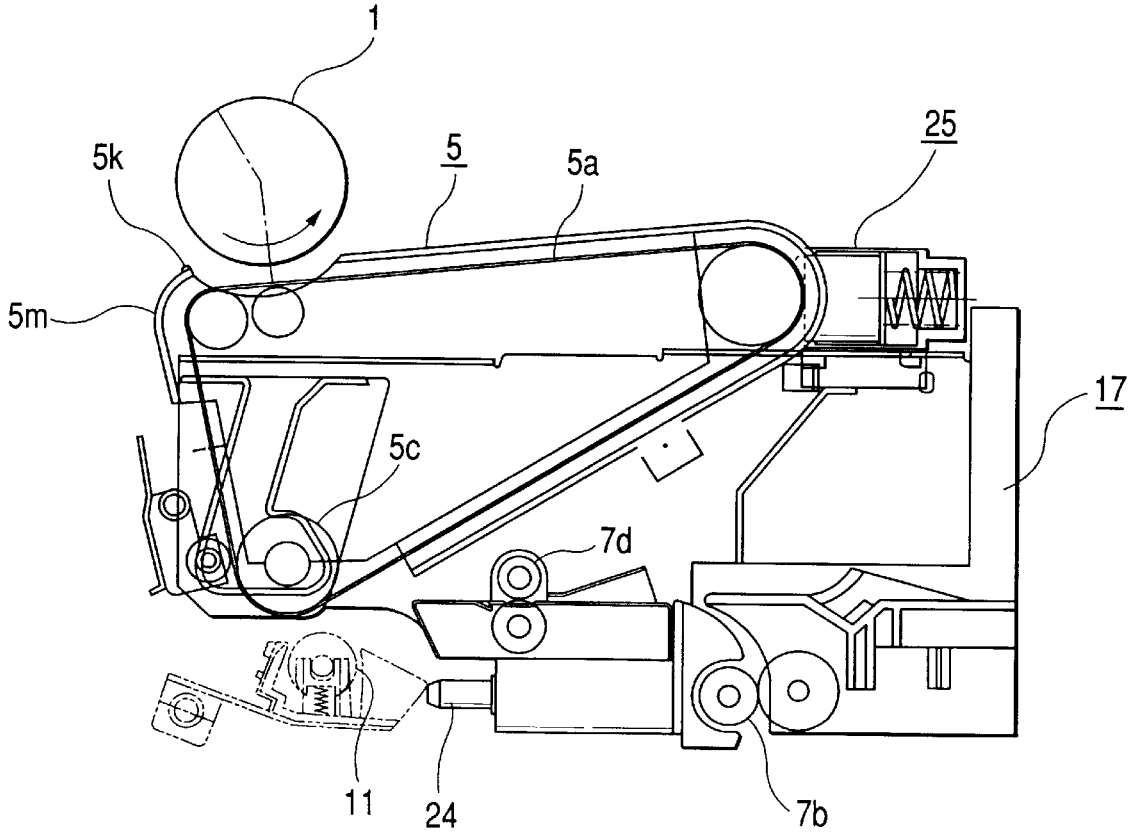
FIG. 6 is a vertical cross-sectional view of the state where the intermediate transfer member is mounted on the main body of the apparatus.

In the situation where the intermediate transfer unit 5 in FIG. 6 or 7 has been mounted in the main body 14, the intermediate transfer belt 5*a* does not contact the photosensitive drum 1. Since the intermediate transfer unit 5 when mounted on the drawing unit 17 is held in place merely by its own weight, even when the intermediate transfer unit 5 is floating, a protrusion 5*k*, which is formed on a facing portion 5*m* of the intermediate transfer unit 5, contacts the facing portion (not shown) of the photosensitive drum 1 and presses the intermediate transfer unit 5 downward, so that the photosensitive drum 1 does not contact the intermediate transfer belt 5*a*. Further, as is shown in FIG. 6, the secondary transfer roller 11 is moved down so that it does not contact the intermediate transfer unit 5.

Figure 13:
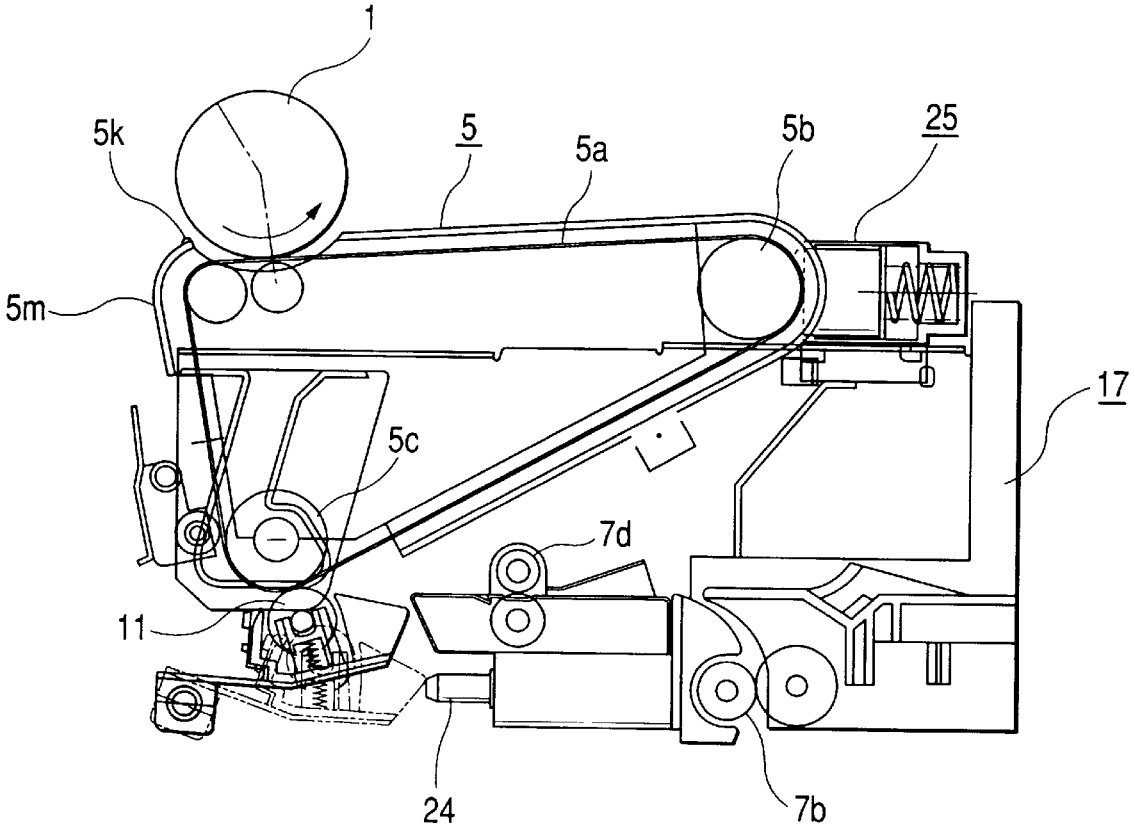
FIG. 13 is a vertical cross-sectional view of the state where a toner image is formed on the intermediate transfer member unit, attached to the main body of the apparatus, and a transfer member.

During the image forming process, as is shown in FIG. 13, the intermediate transfer unit 5 is rotated and raised, by a lifting mechanism (not shown), at the intermediate transfer unit positioning members 29 and 30 (the positioning member 29 also serves as the driving force transmission mechanism), and a predetermined pressure is applied to hold the intermediate transfer belt 5*a* against the photosensitive drum 1.

Then, as is described above, toner images in four colors are superimposed on the intermediate transfer belt 5*a* of the intermediate transfer unit 5, and the secondary transfer roller 11 is raised by a lifting mechanism (not shown) and a predetermined pressure is applied to hold the intermediate transfer belt 5*a*. The toner image is then transferred to the transfer medium P, which is fed in synchronization with the rotation of the intermediate transfer belt 5*a*, whereafter it is fixed to the transfer medium P by the fixing unit 8. Finally, the transfer medium P is discharged to the discharge tray 10.

As is described above, in this embodiment, since the intermediate transfer unit 5 and the transportation means can be pulled out from the front of the main body 14, it is not necessary to form large openings in the frame of the main body on both sides of the rotary shaft of the intermediate transfer belt 5*a*, and it is thus possible to avoid weakening the main body and to prevent the uneven rotation of the intermediate transfer belt 5*a*, which can occur when the main body is weakened. In addition, a user can easily exchange and maintain the intermediate transfer unit 5 and can eliminate such operating problems as paper jams.

A detachment mechanism for the processing cartridge B will now be described.

Figure 14:
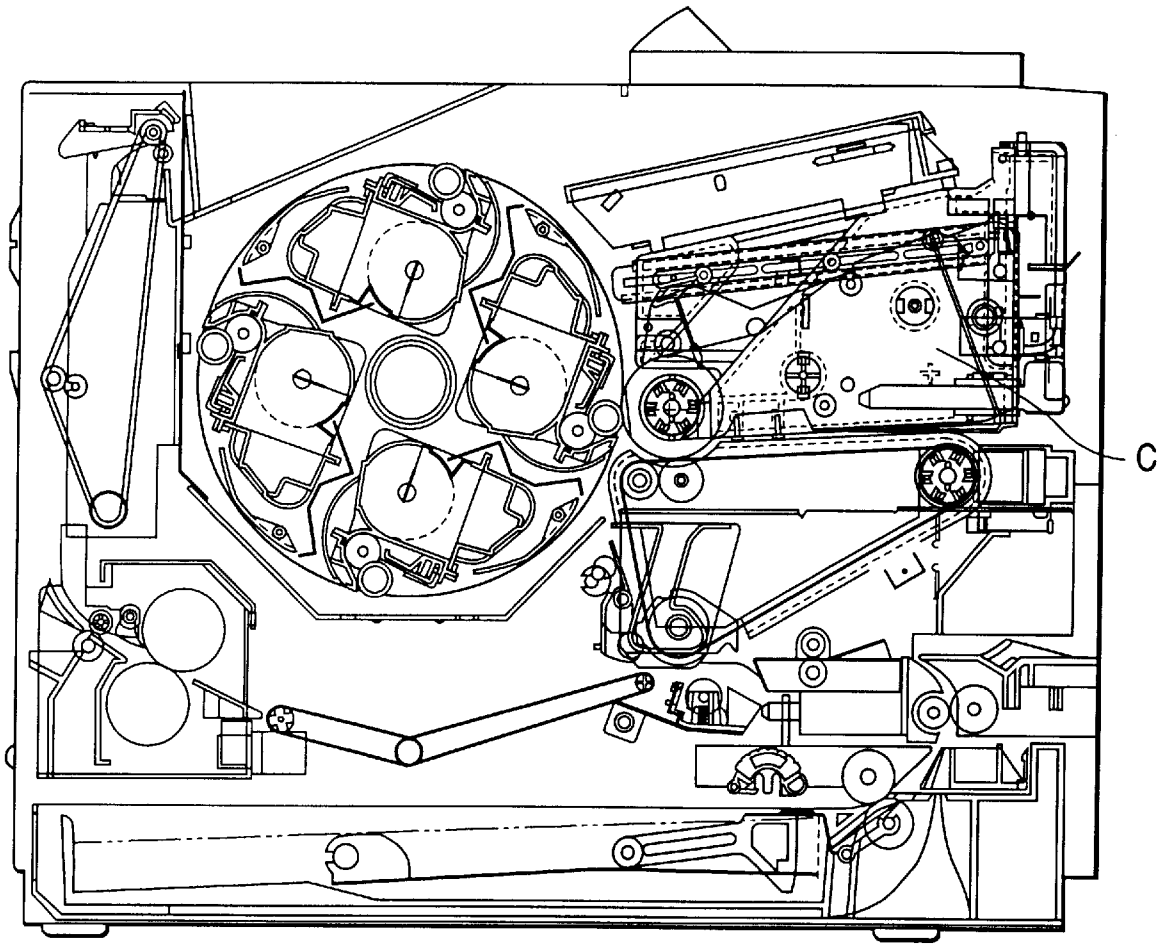
FIG. 14 is a vertical cross-sectional view of the state where an image bearing member unit is mounted on the main body of the apparatus.

In FIG. 14 is shown the state where the processing cartridge B (hereinafter referred to as a cartridge B) is mounted on a drawing movable member C that serves as second drawing unit means and occupies a predetermined location inside an image forming apparatus A.

Figure 15:
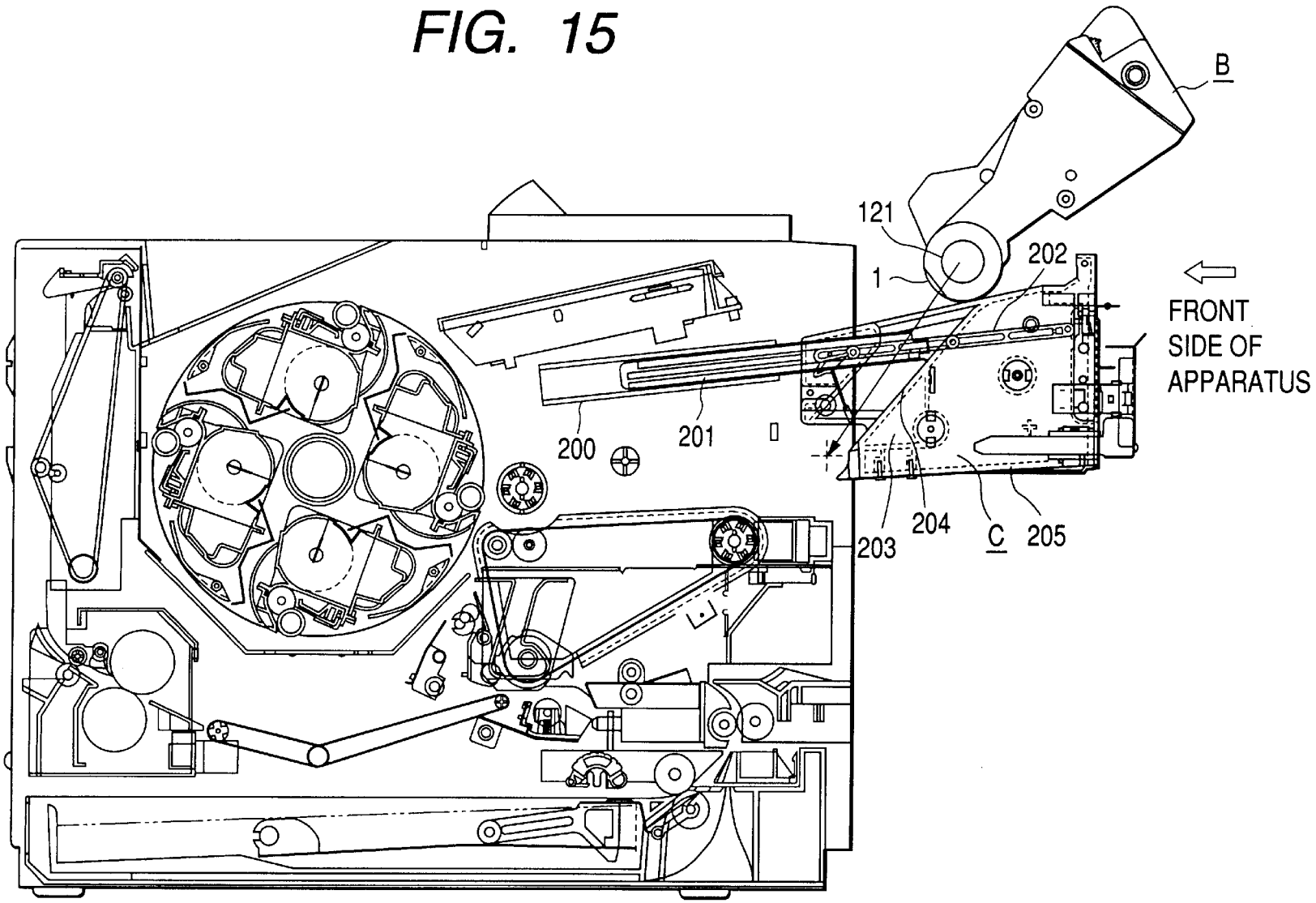
FIG. 15 is a vertical cross-sectional view of the state where the image bearing member unit is pulled out.

In FIG. 15 is shown the state wherein the movable unit C bearing the cartridge B has been removed from the apparatus.

The drawing movable member C in FIG. 15 is so designed that a first slide rail 201 slides and moves along guide rails that are securely fixed at either side of the apparatus, while a second slide rail 202 slides inside the first slide rail 201, and thus increases the distance travelled by the drawing movable member C bearing the cartridge B when it is withdrawn from the apparatus. For the first and the second slide rails 201 and 202 stoppers 201*a* and 202*a* are provided that stop them at predetermined locations. Positioned on both sides of a bottom plate 205 of the drawing movable member C are side plates L203 and R206 in which are formed guide grooves 204 along which the cartridge B is loaded and unloaded. A holding member 121, which is coaxially formed with the photosensitive drum 1 of the cartridge B, and a holding member 122, which has an internal driving force transmission section, are removed from the drawing movable member C by being drawn out along the guide grooves 204 formed on both sides.

Figure 16A:
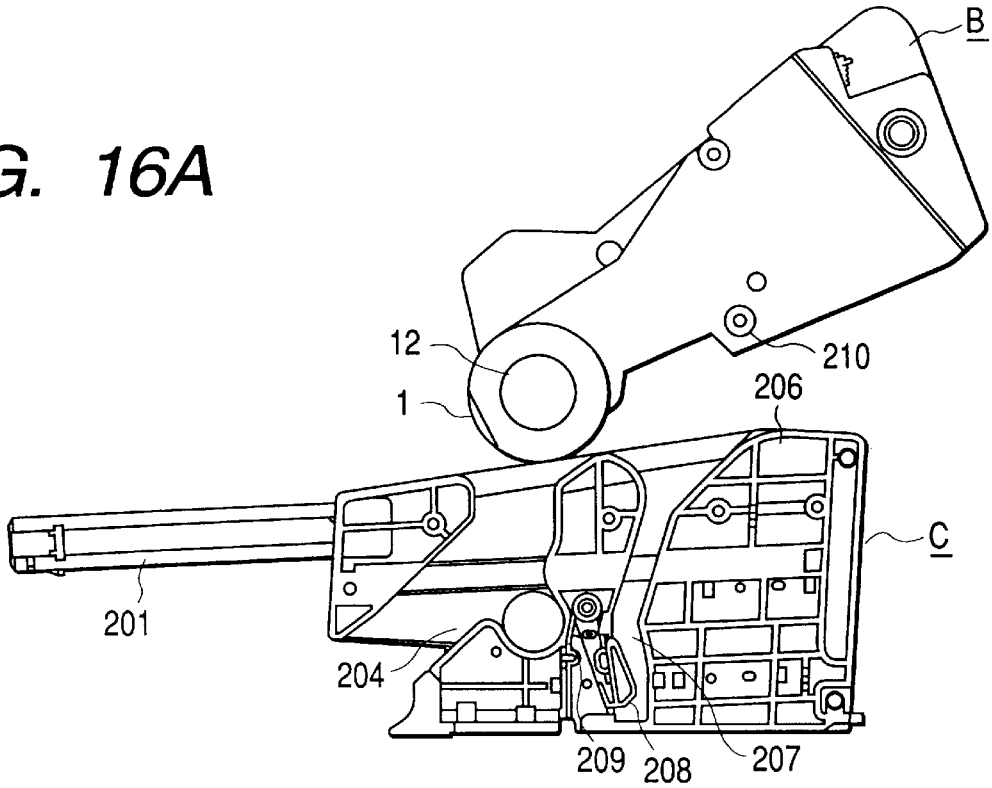
FIGS. 16A, 16B and 16C are vertical cross-sectional views of the process for mounting the image bearing member unit on a movable member unit.
Figure 16B:
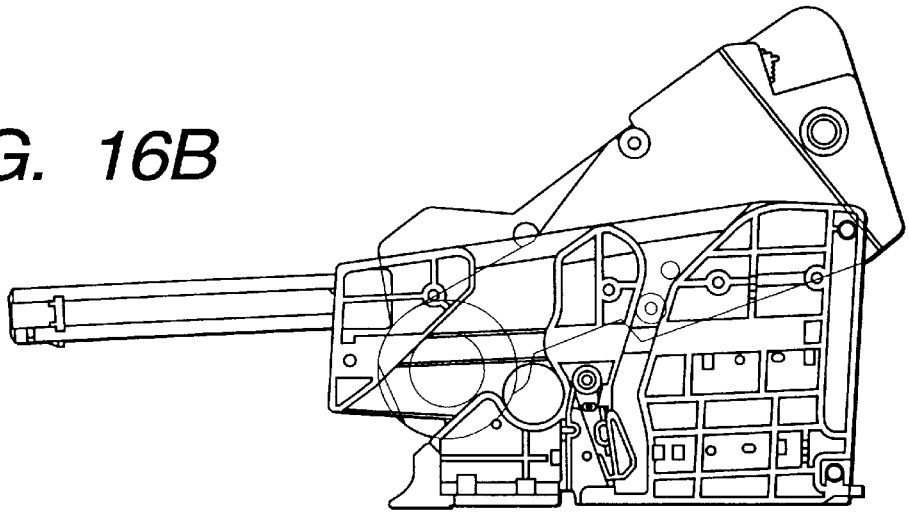
Figure 16C:
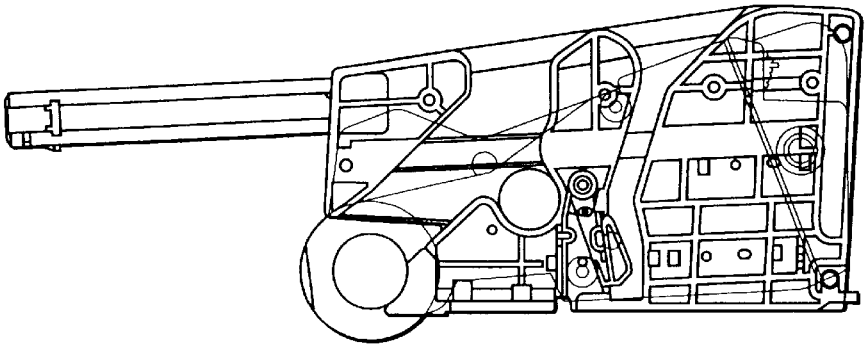

FIGS. 16A to 16C are diagrams showing the state shifting for detaching the cartridge B from the drawing movable member C.

The guide grooves 204, along which is guided the holding members 122, which are coaxially formed with the photosensitive drum 1, and auxiliary guide grooves 207, by which the posture of the cartridge B is supported while the cartridge B is being inserted, are provided at either side, and the holding members 122 are inserted as is shown in FIGS. 16A to 16C. At this time a pressing member 208, which is located at the bottom of the auxiliary guide groove 207, applies pressure supplied by a twisted coil spring 209 to bosses 210 on the sides of the cartridge B to stabilize the positioning of the cartridge B and to engage and to secure it after it is loaded.

Figure 17:
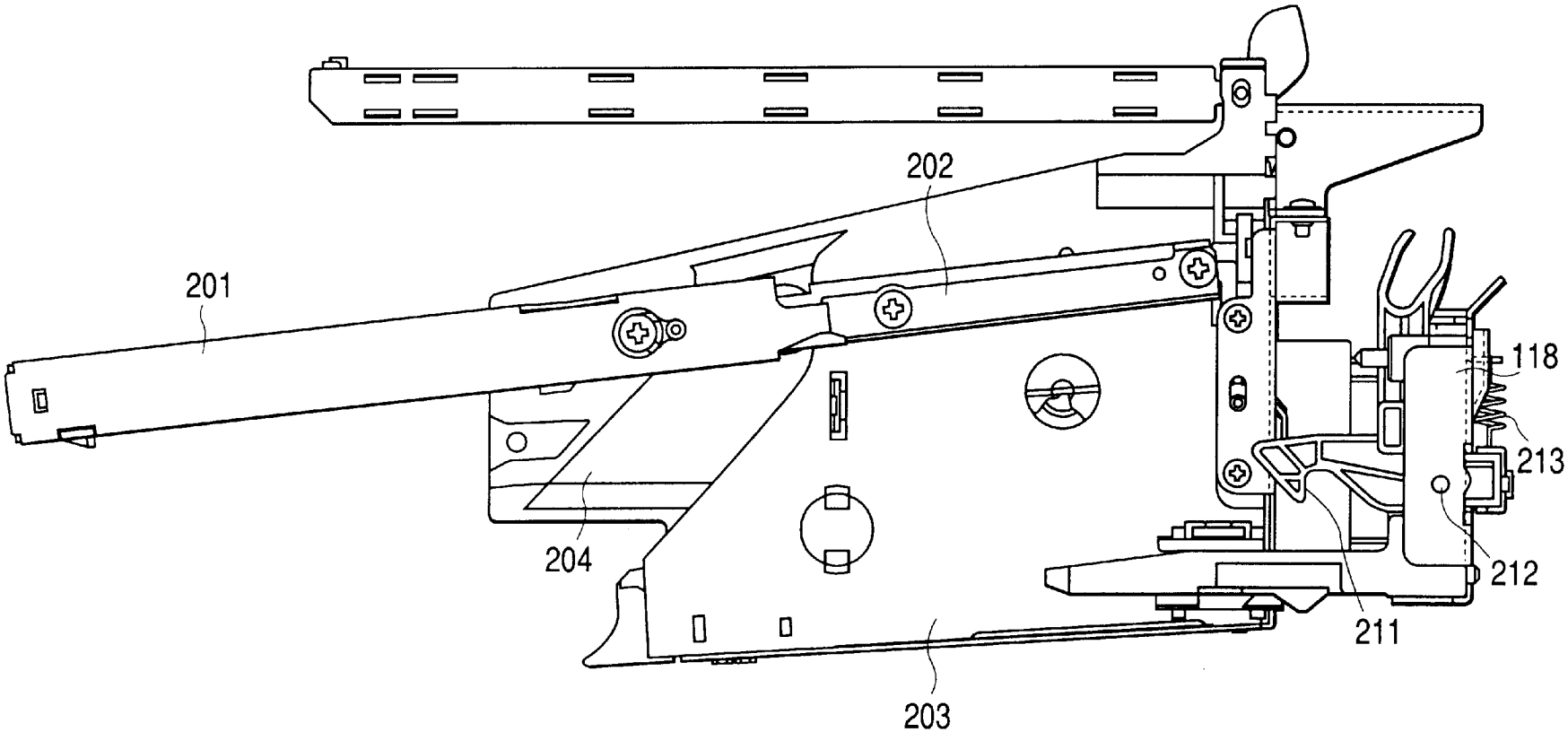
FIG. 17 is a side view of the movable member unit.
Figure 18:
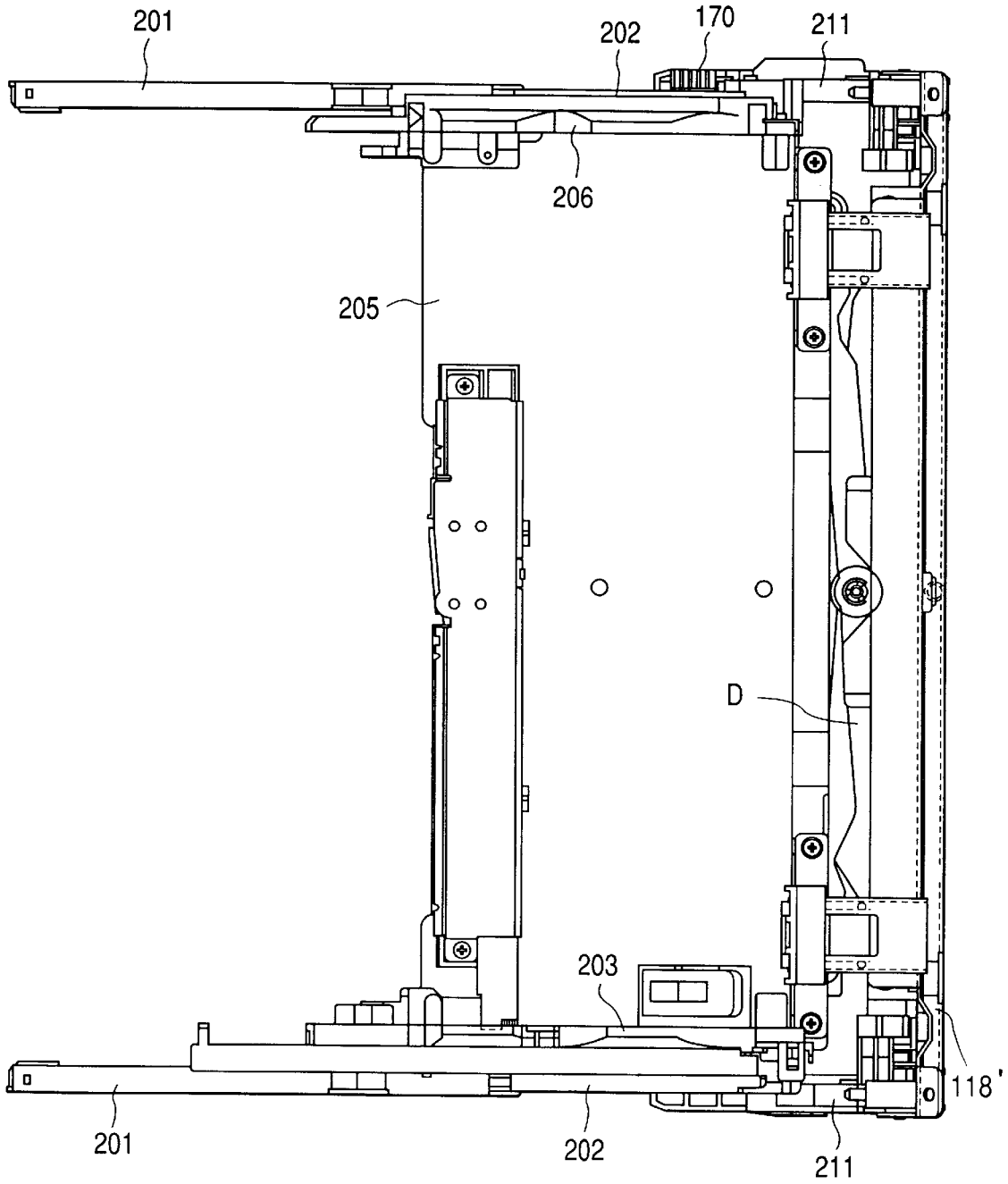
FIG. 18 is a top view of the movable member unit.

FIG. 17 is a side view of the drawing movable member C, and FIG. 18 is a top view.

In FIGS. 17 and 18, the first slide rail 201 and the second slide rail 202 are provided, and the side plates L203 and R206 are symmetrically positioned by the bottom plate 205. Locking levers 211 on the sides of the side plates L203 and R206 are linked by a shaft 212, and forced into predetermined positions by a tension spring 213. When the drawing movable member C is pushed into the apparatus, the locking levers 211 are locked by engaging positioning pins in the apparatus, and the drawing movable member C, i.e., the cartridge B, is loaded at a predetermined location.

Figure 19:
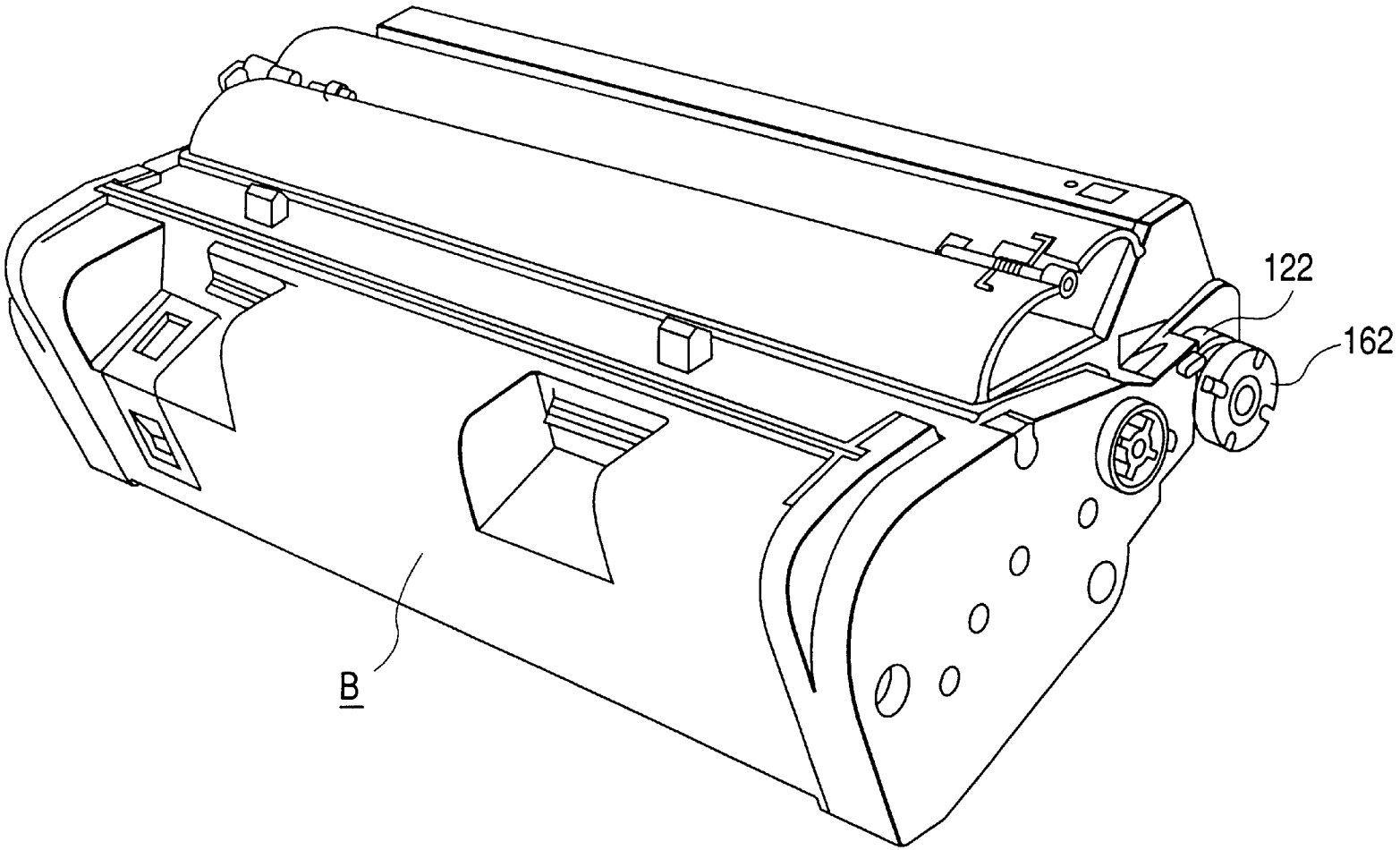
FIG. 19 is a perspective view of the image bearing member unit.
Figure 20:
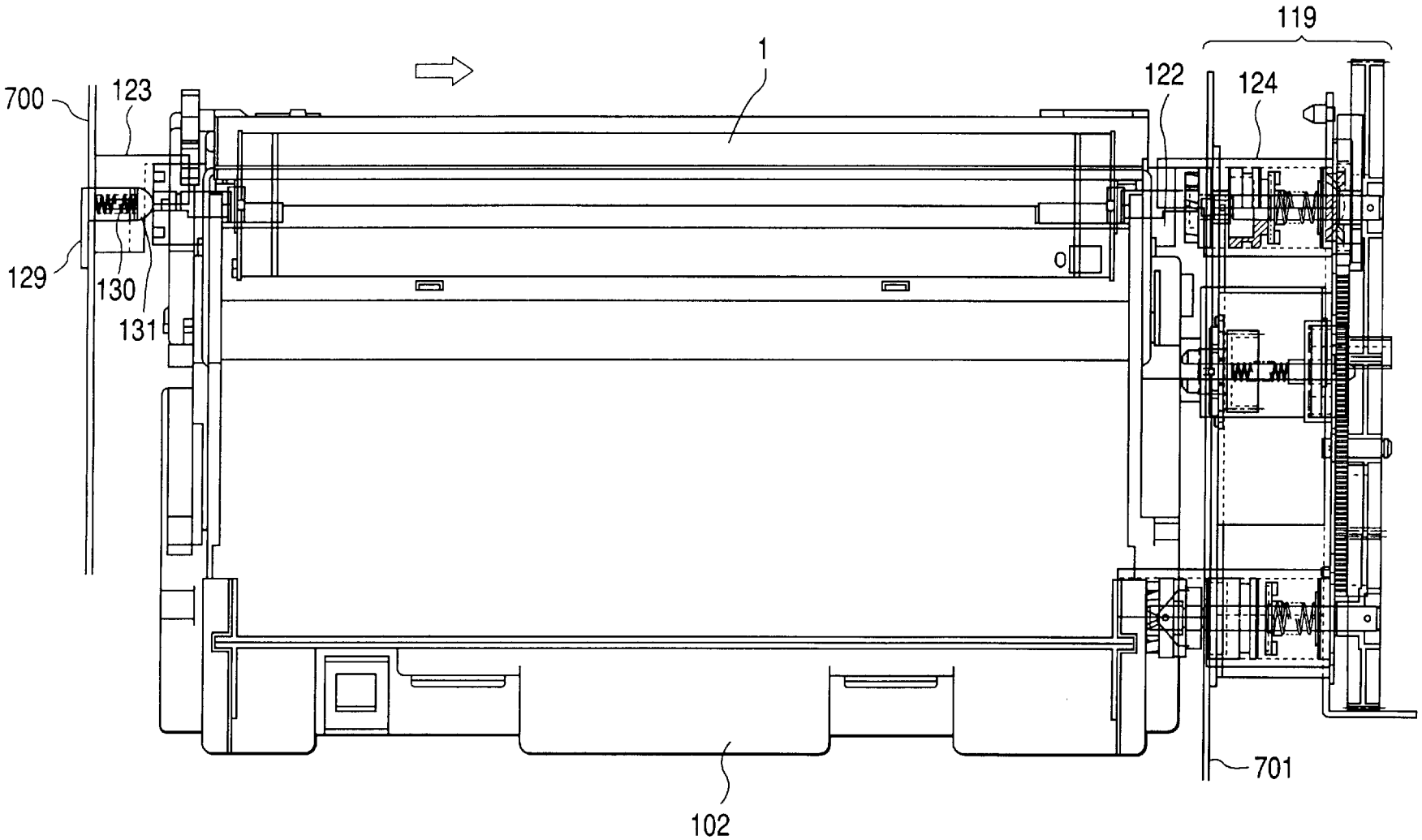
FIG. 20 is an explanatory top view of the image bearing member when it is attached to the main body of the apparatus.

FIG. 19 is a perspective view of the cartridge B and FIG. 20 is a top view of the cartridge B when it is loaded in the apparatus at a predetermined location.

Figure 27A:
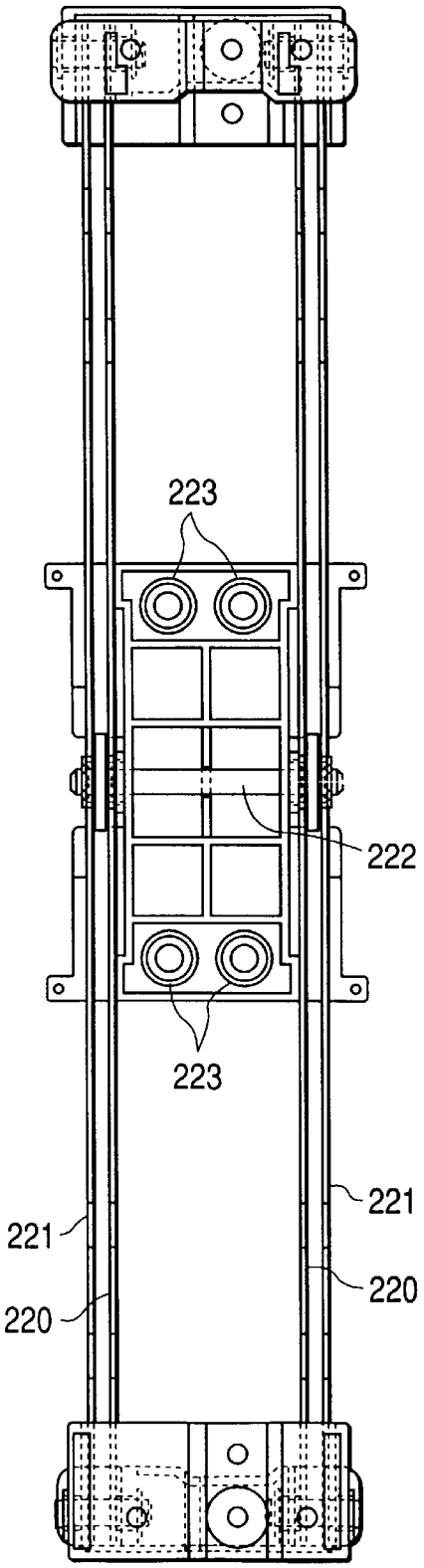
FIGS. 27A and 27B are explanatory diagrams showing a pressure guide.
Figure 27B:
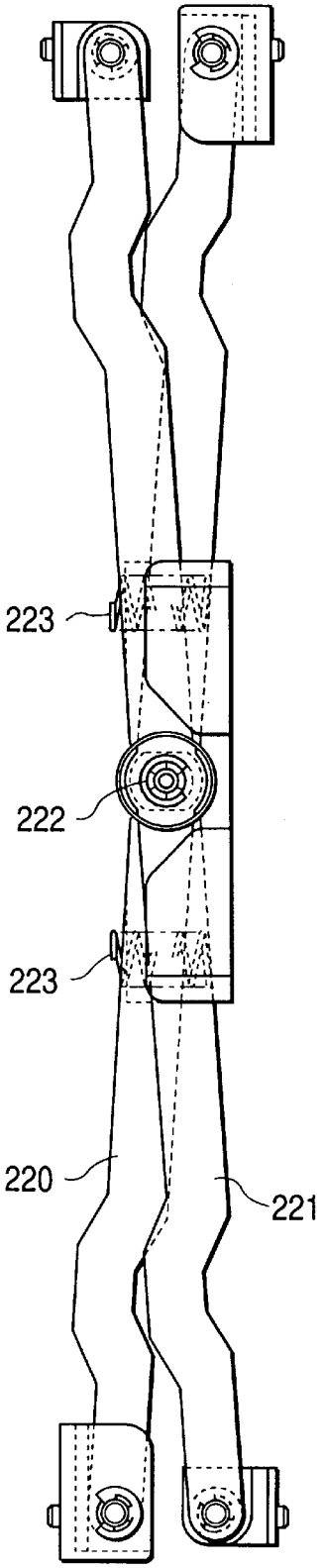

In FIGS. 27A and 27B, a pressure guide unit D provided at the front of the drawing movable member C applies pressure to the entire drawing movable member C to force it into a predetermined location in the image forming apparatus. The pressure guide unit D is so designed that the levers 220 and 221, which rotate at the shaft 222, are assembled like a pantograph, and so that the coil spring 223 drives a stay 118 for which the locking lever 211 is designed to engage. With this structure, a uniform force is applied even when the drawing movable member C is pushed at both ends. As a result, the drawing movable member C can be smoothly closed, without any distortion. When the unit C is locked, the force is exerted and drives the drawing movable member C toward the outside of the apparatus so as to stabilize the drawing movable member C at its predetermined location in the apparatus.

The engagement and disengagement of the cartridge B relative to the apparatus A will now be described.

The cartridge B is removed from the apparatus A while mounted on the drawing movable member C, and is then removed from the drawing movable member C. A pressure guide 118 is formed to lock the drawing movable member C in the apparatus A. The pressure guide 118 has a function for bringing the cartridge B into contact with the apparatus A, via the drawing movable member C, and a function for continuously driving the cartridge B and the drive unit 119, which will be described later.

The rotary shafts on both sides of the photosensitive drum 1 of the cartridge B are supported by the internal surfaces of the holding members 121 and 122, which have positioning and bearing functions. The holding members 121 and 122 are externally and cylindrically formed around the rotational axis of the photosensitive drum 1, and protrude from either side of the cartridge B. The holding member 121 is brought into contact with a positioning member 123 that is fixed to a side plate 700, and is positioned there. The holding member 122 is brought into contact with the internal face of a pipe member 124, which is provided for the drive unit 119, and is positioned there. The outer face of the pipe member 124 is positioned at a side plate 701. One end of the cartridge B is positioned directly adjacent to the drive unit 119, and the other end is positioned at the main body of the apparatus A. While it is conductive, a contact member 129 is fixed to the side plate 700 as a drum earth contact point. A contact point pin 131 and a contact point spring 130 are provided for the member 129, and are shifted in the direction indicated by an arrow and brought into contact with the photosensitive drum 1 of the cartridge B so as to render the photosensitive drum 1 and the slide plate 700 conductive.

Figure 21:
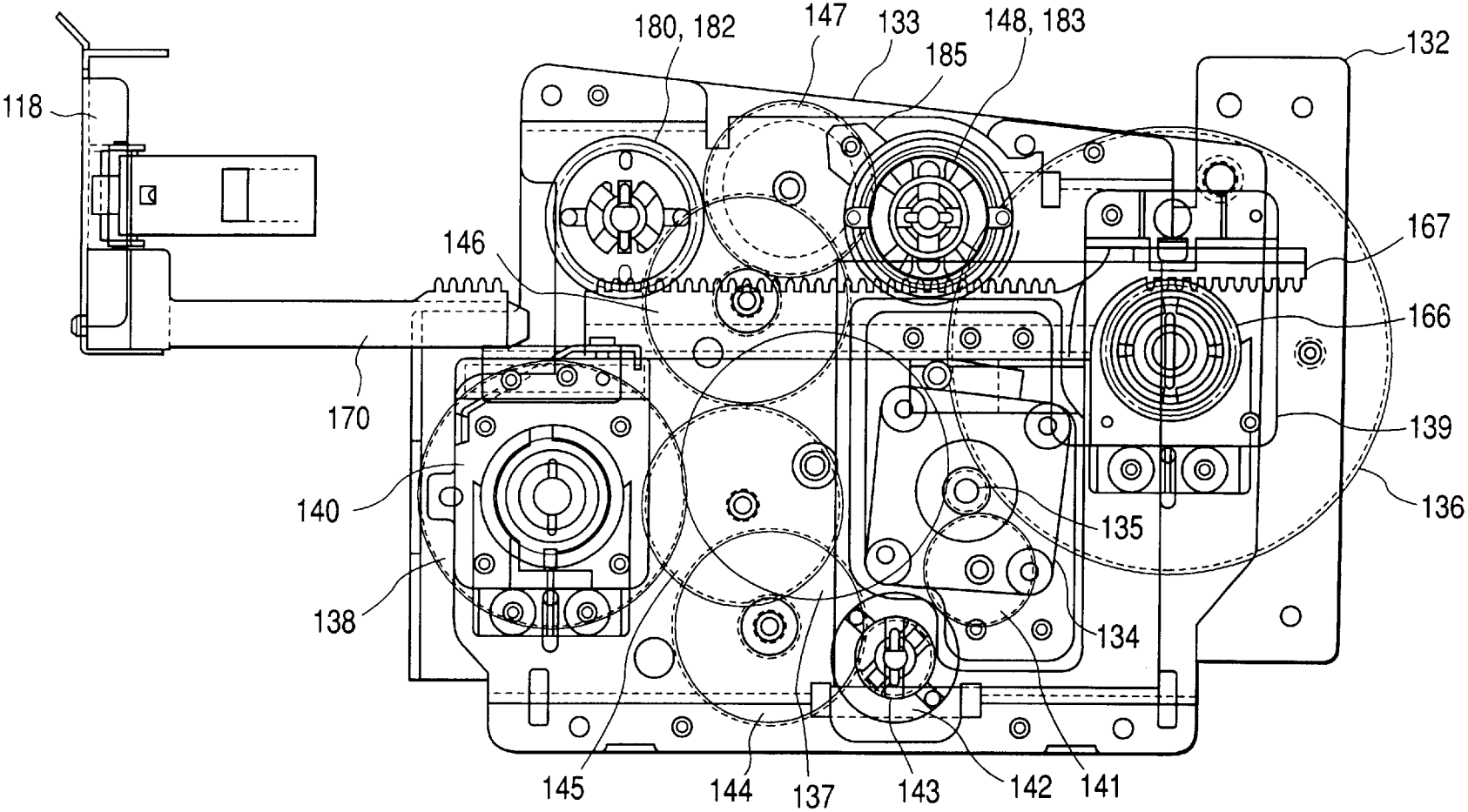
FIG. 21 is an explanatory diagram showing a drive member.
Figure 22:
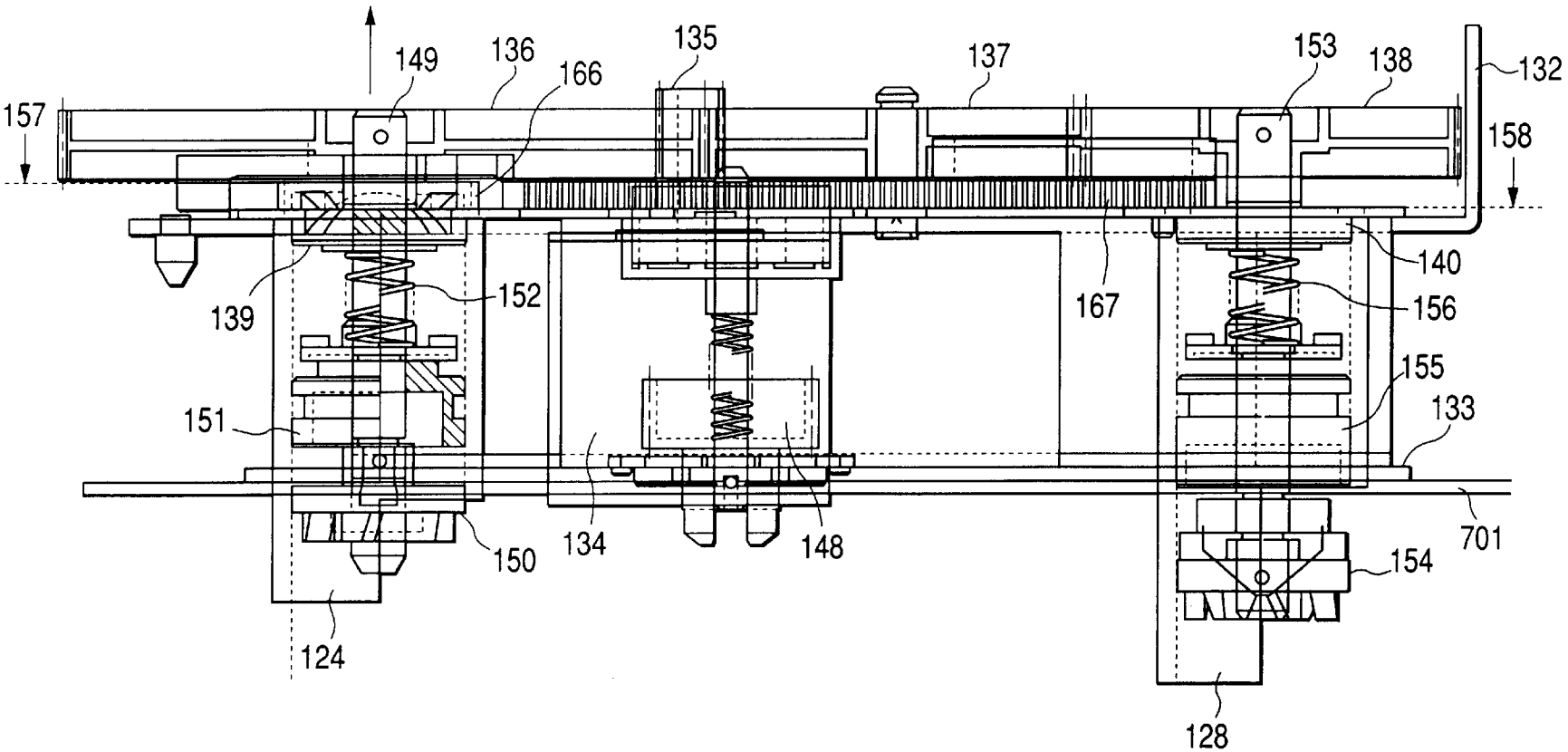
FIG. 22 is an explanatory diagram showing the drive member.

In FIGS. 21 and 22 is shown the drive unit 119. The drive unit 119 is shaped like a box, is formed by using an upper stay 132 and a lower stay 133. A motor 134 is also included, and a motor gear 135 is attached to the motor 134. A drum drive gear 136 and an intermediate transfer unit drive idle gear 137, and a used toner agitating idle gear 141 engage the gear 135. The gear 137 is coupled to an intermediate transfer unit roller drive gear 140. The gear 141 constitutes a driving force transmission system for transmitting the driving force to an agitating coupling gear 148 via other agitating idle gears 142 to 147.

In FIG. 22, while using the external diameters of the pipe members 124 and 128 as a reference, the stays 132 and 133 are assembled together and are positioned on the side plate 701.

Bearings 139 and 151 are provided for the pipe member 124 while using its internal diameter as a reference. Bearing member 139 is fixed to the upper stay 132, and a rotary shaft 149 is fixed to the center of the bearing 139. The drum gear 136 is provided at one end of the rotary shaft 149, and a drum coupling member 150 is so provided at the other end that they can be rotated together and can slide in the direction indicated by an arrow. A slide spring 152 is located between the bearing 139 and the shaft 149, and the gear 136 is brought into contact with a contact reference face 157 by the force exerted by the spring 152. The mechanism for a pipe member 128 on the intermediate transfer unit drive side has the same structure.

Figure 23:
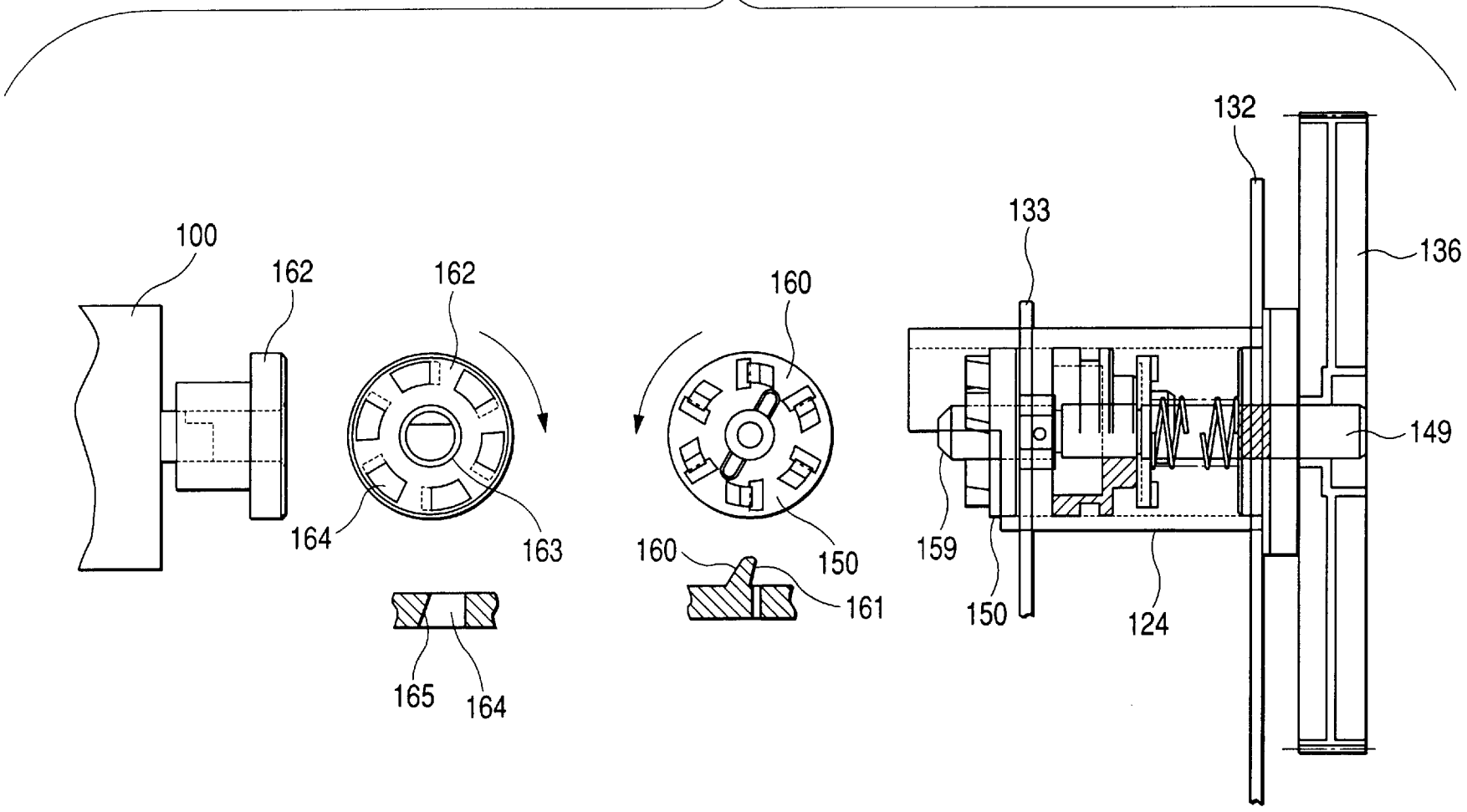
FIG. 23 is an explanatory diagram showing a coupling member.
Figure 24:
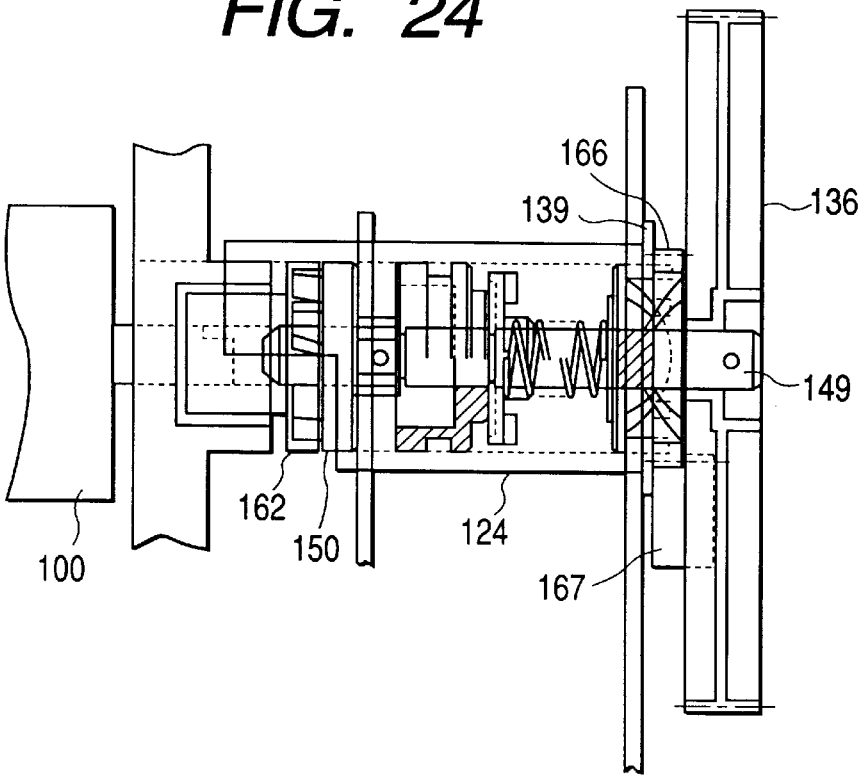
FIG. 24 is an explanatory diagram showing a slide mechanism for the coupling member.
Figure 25:
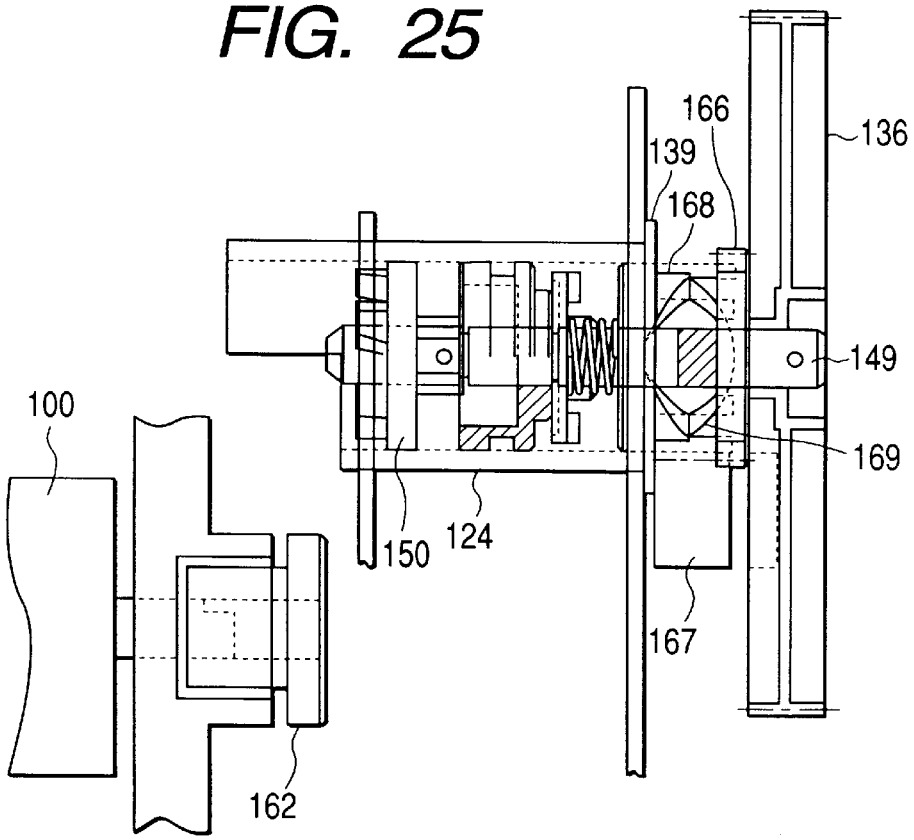
FIG. 25 is an explanatory diagram showing the slide mechanism for the coupling member.

In FIG. 23 is shown in detail the drum coupling member 150. A core fixing portion 159 of the rotary shaft 149 is provided at the center of the rotation of the drive coupling member 150, and is fitted into a core fixing hole 163 that is formed in the center of a drum coupling member 162. A plurality of projections 160 are formed on the coupling member 150 for transmitting the driving force, and these engage a plurality of holes 164 that are formed in the drum coupling member 162. For the transmission of the driving force, sloping faces 161 and 165, which are formed on the projections 160 and in the holes 164, contact each other, and coupling power is exerted to pull the coupling members together. In FIGS. 24 and 25 is shown a slide mechanism for the drum coupling members. A cam 168 is formed on the bearing 139, and a cam gear 166, on which is mounted a male or a female cam 169, positioned relative to the cam 168, is located between the gear 136 and the bearing 139 and has as its central axis the rotary shaft 149. The cam gear 166, which is rotated by a rack member 167, is in the coupled state, shown in FIG. 24, when the recessed portion of the cam 168 engages the raised portion of the cam 169. The coupling of the cam gear 166 is released when the raised portions of the cams 168 and 169 face each other.

Figure 26A:
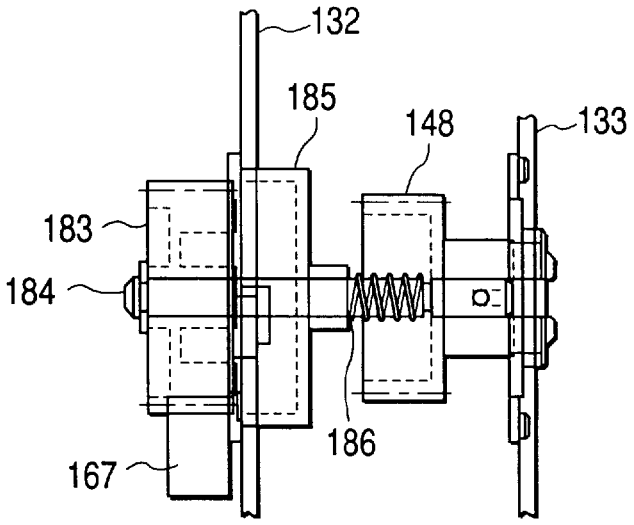
FIGS. 26A, 26B and 26C are explanatory diagrams showing an agitate coupling member.
Figure 26B:
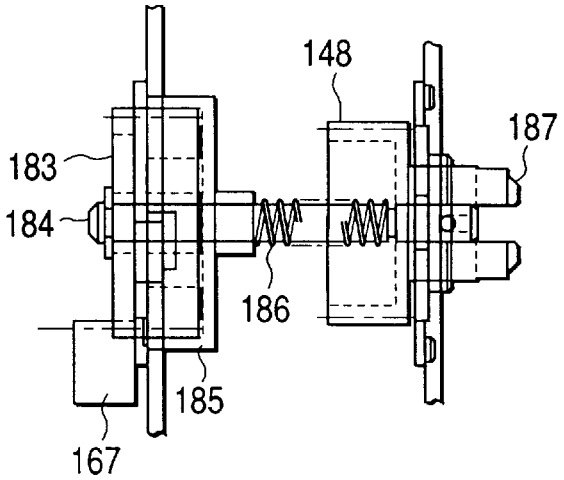
Figure 26C:
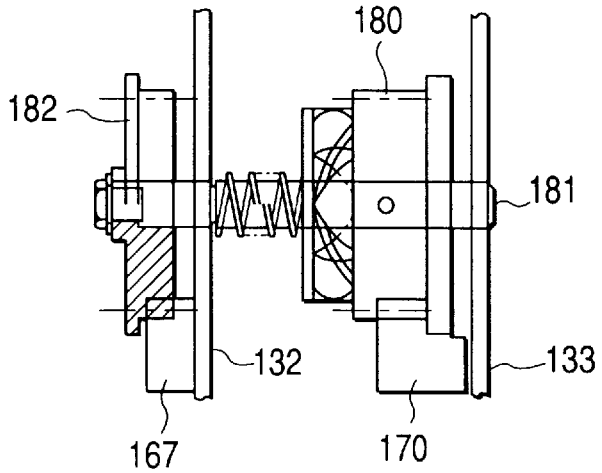

The operation performed by an agitating coupling member slide mechanism and the rack member 167 will now be described while referring to FIGS. 21, and 26A and 26B. Pawls 187 that engage the cartridge B are formed on an agitating coupling member 148, and the agitating coupling member 148 and a shaft 184 that are also provided rotate together. At one end of the shaft 184 are attached a rotatable cam gear 183 and a bearing member 185, which has a cam face corresponding to the cam face of the cam gear 183. The bearing member 185 is fixed to the upper stay 132, and a slide spring 186 is located between the bearing 185 and the agitating coupling member 148. When the cam gear 183 is rotated by the rack member 167, and the cam faces engage each other, the agitating coupling member 148 is slid to the right. The rack member 167 interacts with the movement of the pressure guide unit D when a guide rack 170, which is provided for the pressure guide unit D of an upper drawing unit 117, engages a gear 180 of the drive unit 119, and when the gear 182 is rotated via the shaft 181 that rotates with the gear 180. Therefore, when the drawing movable member C on which the cartridge B is mounted and the pressure guide unit D are pushed into the apparatus A, the guide rack 170 engages the drive unit 119, the rack member 167 interacts with the engagement, and the drum coupling member and the agitating coupling member are coupled together with the cartridge B. To remove the cartridge B, first, the pressure guide member 118 is pulled to the front and the guide rack member 170 and the rack member 167 interact accordingly, the drum coupling member disengages the agitating coupling member, and finally the drawing movable member C, with the cartridge B mounted thereon, is pulled out of the apparatus A.

As is described above, according to the present invention, since the cartridge B, as well as the intermediate transfer unit 5, can be horizontally pulled out of the main body 14 of the apparatus, the formation of large openings is not required in the frame of the main body on both sides of the rotary shaft of the photosensitive drum 1, so that it is possible to avoid weakening the main body and prevent the uneven rotation of the photosensitive drum 1, which can occur when the strength of the main body is reduced. That is, deterioration of image quality due to uneven rotation can be prevented. In addition, a user can easily exchange and maintain the cartridge B.

In the above embodiment, an intermediate, belt type transfer member has been employed. However, the intermediate transfer member unit may have a drum shape. Also, not only can an image bearing member having a drum shape be employed, but also a belt type image bearing member can be employed.

As is described above, according to the present invention, since the intermediate transfer unit and the image bearing member unit can be detached from the image forming apparatus in a direction perpendicular to the rotational axial direction of the intermediate transfer unit and the image bearing member unit, it is possible to avoid weakening the structure of the apparatus and to prevent the uneven rotation of the intermediate transfer unit and the image bearing member, which can occur when the main body of the apparatus is weakened. Further, since the exchange of these units can be performed at the same face of the main body of the apparatus, a user can smoothly replace the units and can eliminate jams easily.

What is claimed is:

1. An image forming apparatus comprising:

an image bearing member unit having a rotatable image bearing member for holding an image; and an intermediate transfer member unit having a rotatable intermediate transfer member to which said image on said image bearing member is transferred, the image transferred to said intermediate transfer member being transferred to a transfer material;

wherein said image bearing member unit and said intermediate transfer member unit are attachable and detachable from a single same side wall of a main body of said image forming apparatus in a direction perpendicular to rotational axes of said image bearing member and said intermediate transfer member.

2. An image forming apparatus according to claim 1, further comprising first drawing unit means on which said intermediate transfer member unit is mountable, said first drawing unit means being removable outside from said main body together with said intermediate transfer member unit with said intermediate transfer member unit being mounted on said first drawing unit means.

3. An image forming apparatus according to claim 2, wherein said first drawing unit means enables said intermediate transfer member unit to be horizontally withdrawn from said main body.

4. An image forming apparatus according to claim 3, wherein said first drawing unit means has respective rail members at both ends in a rotational axial direction of said intermediate transfer member.

5. An image forming apparatus according to claim 4, wherein said first drawing unit means has a plurality of rail members at one end in the rotational axial direction of said intermediate transfer member unit.

6. An image forming apparatus according to claim 2, further comprising means, in association with removal and mounting of said intermediate transfer member unit from and on said main body by said first drawing unit means, for disconnecting and connecting said intermediate transfer member unit to driving means for rotating said intermediate transfer member.

7. An image forming apparatus according to claim 2, wherein said first drawing unit means includes a regulate member for regulating a position at which said intermediate transfer member unit is mounted on said first drawing unit means.

8. An image forming apparatus according to claim 1, further comprising convey means for conveying said transfer material to a transfer position at which the image on said intermediate transfer member is transferred to the transfer material.

9. An image forming apparatus according to claim 8, wherein said convey means is detachable from said main body.

10. An image forming apparatus according to claim 9, wherein said convey means is fixed to said first drawing unit means.

11. An image forming apparatus according to claim 1, further comprising convey means for conveying said transfer material to a transfer position at which the image on said intermediate transfer member is transferred to the transfer material wherein said convey means is attachable and detachable from the same side wall.

12. An image forming apparatus according to claim 2, further comprising second drawing unit means on which said image bearing member unit is mountable, said second drawing unit means being removable outside from said main body together with said image bearing member unit with said image bearing member unit being mounted on said second drawing unit means.

13. An image forming apparatus according to claim 12, wherein said second drawing unit means enables said image bearing member unit to be removed horizontally from said main body.

14. An image forming apparatus according to claim 13, wherein said second drawing unit means has respective rail members at both ends in a rotational axial direction of said image bearing member.

15. An image forming apparatus according to claim 14, wherein said second drawing unit means has a plurality of rail members at one end in a rotational axial direction of said image bearing member.

16. An image forming apparatus according to claim 12, wherein when said second drawing unit means is pushed toward said main body, a pressing force exerted against said second drawing unit means is substantially constant, regardless of position where said second drawing unit means is pushed.

17. An image forming apparatus according to claim 14, further comprising means, in association with removal and mounting of said image bearing member unit from and on said main body by said second drawing unit means, for disconnecting and connecting said image bearing member unit to driving means for rotating said image bearing member.

18. An image forming apparatus according to claim 17, wherein said image bearing member unit includes a toner collection container in which toner is collected from said image bearing member and is retained, and wherein transmitting and releasing of a driving force to transporting member, which transports said toner to said collection container, interacts with load and unload said image bearing member unit relative to said main body by said second drawing unit means.

19. An image forming apparatus according to claim 12, wherein said second drawing unit means removes said image bearing member unit outside from said main body with keeping said image bearing member unit in its attitude.

20. An image forming apparatus according to claim 12, wherein said second drawing unit means constitutes a portion of said side wall.

21. An image forming apparatus according to claim 12, wherein said side wall is a front of said image forming apparatus.

22. An image forming apparatus according to claim 1, wherein said image bearing member unit includes cleaning means for removing toner from said image bearing member.

23. An image forming apparatus according to claim 22, wherein said image bearing member unit includes a collection container in which toner collected by said cleaning means is retained.

24. An image forming apparatus according to claim 1 or 22, wherein said image bearing member unit includes charging means for charging said image bearing member.

25. An image forming apparatus according to claim 2, wherein said first drawing unit means removes said intermediate transfer member unit outside from said main body with keeping said intermediate transfer member unit in its attitude.

26. An image forming apparatus according to claim 2, wherein said first drawing unit means constitutes a portion of said side wall.

27. An image forming apparatus according to claims 1 or 2, wherein said side wall is a front of said image forming apparatus.

28. An image forming apparatus according to claims 1 or 2, wherein said intermediate transfer member unit has a handle.

29. An image forming apparatus according to claim 1, wherein a plurality of color images are sequentially transferred from said image bearing member to said intermediate transfer member, and the plurality of color images on said intermediate transfer member are transferred to the transfer material.

* * * * *

UNITED STATES PATENT AND TRADEMARK OFFICE

CERTIFICATE OF CORRECTION

PATENT NO. : 6,115,568
DATED : September 5, 2000
INVENTOR(S) : TAKAO SAMESHIMA

It is certified that error appears in the above-identified patent and that said Letters Patent is hereby corrected as shown below:

COVER PAGE AT ITEM [57] ABSTRACT:
Line 8, "intermediate" should read —the intermediate—.

COLUMN 11:
Line 10, "stay 118" should read —stay 118'—.

Signed and Sealed this

Fifth Day of June, 2001

*Attest:*

*Attesting Officer*

Nicholas P. Godici

NICHOLAS P. GODICI

*Acting Director of the United States Patent and Trademark Office*